US008416045B2

(12) United States Patent
Henning, III et al.

(10) Patent No.: US 8,416,045 B2
(45) Date of Patent: Apr. 9, 2013

(54) MAGNETIC POWER CONVERTER

(75) Inventors: Harvey S. Henning, III, Madison, AL (US); David L. Priputen, Madison, AL (US)

(73) Assignee: OnyxIP, Inc., Huntsville, AL (US)

( * ) Notice: Subject to any disclaimer, the term of this patent is extended or adjusted under 35 U.S.C. 154(b) by 0 days.

(21) Appl. No.: 13/169,737

(22) Filed: Jun. 27, 2011

(65) Prior Publication Data

US 2012/0161917 A1 Jun. 28, 2012

(51) Int. Cl.
*H01F 21/00* (2006.01)
*H01F 27/24* (2006.01)
*H01F 17/04* (2006.01)

(52) U.S. Cl.
USPC ..... 336/110; 336/212; 336/214; 336/221

(58) Field of Classification Search ..... 336/110, 336/155, 160, 177, 212, 214, 221
See application file for complete search history.

(56) References Cited

U.S. PATENT DOCUMENTS 2,339,406 A * 1/1944 Holden ..... 330/122
2,615,155 A * 10/1952 Ogle ..... 322/28
2,725,520 A * 11/1955 Woodworth ..... 323/330
2,904,743 A 9/1959 McClain
3,404,358 A * 10/1968 Braumann et al. ..... 335/78
3,444,458 A * 5/1969 Scott ..... 324/243
3,521,152 A * 7/1970 Emerson ..... 323/309
3,593,135 A * 7/1971 Schwartz ..... 324/151 A
3,968,465 A * 7/1976 Fukui et al. ..... 336/110
4,031,457 A * 6/1977 Oberbeck ..... 323/362
4,415,841 A 11/1983 Willis et al.
4,883,977 A 11/1989 Regan
5,754,086 A 5/1998 Ichida et al.
5,986,860 A 11/1999 Scott
6,066,998 A * 5/2000 Trumper et al. ..... 335/229
6,246,561 B1 6/2001 Flynn
6,362,718 B1 3/2002 Bearden
6,717,504 B2 * 4/2004 Fujiwara et al. ..... 336/233
6,822,546 B1 11/2004 Jakab et al.
6,909,352 B2 * 6/2005 Hobson et al. ..... 336/178
7,889,040 B2 * 2/2011 Viitanen et al. ..... 336/110
8,059,428 B2 * 11/2011 Laitinen et al. ..... 363/12
2002/0075113 A1 6/2002 Jitaru
2004/0036454 A1 2/2004 Joerg et al.
2007/0236321 A1 10/2007 Iwai
2008/0303620 A1 12/2008 Viitanen et al.
2009/0079532 A1 3/2009 Muelleman
2010/0283571 A1 11/2010 Dellacona

* cited by examiner

*Primary Examiner* — Mohamad Musleh
*Assistant Examiner* — Joselito Baisa
(74) *Attorney, Agent, or Firm* — Ann I. Dennen; Lanier Ford Shaver & Payne, P.C.

(57) ABSTRACT

A rare earth magnet is observed to function as a constant flux generator until coerced. To exploit this law, a Magnetic Power Converter is configured as a figure eight shaped balanced reluctance bridge where a rare earth magnet provides a source of constant flux employed as a working fluid. One side of the bridge drives an output coil and the other side is moderated by a toroid shaped control core acting as a variable reluctance shunt with respect to the magnet. Current in the control coil determines the rate and degree of flux variation across the bridge and therefore the resultant output voltage. Due to a mitigation of Lenz effect, full output loading is not reflected in the input; this property supports real power conversion efficiencies that may have wide applications in alternative energy and green energy generation.

16 Claims, 20 Drawing Sheets

MAGNETIC POWER CONVERTER

BACKGROUND AND SUMMARY

The present disclosure generally pertains to power converters. Power converters, such as, for example, transformers, are typically used to convert electrical energy from one circuit into a suitable form for use in another circuit. Thus, power converters may be used to regulate voltage, current, or frequency between circuits. Typical power converters often utilize one or more input or primary coils positioned around a ferromagnetic core, and one or more output coils positioned around another portion of the core. The input coils are used to produce a magnetic flux in the core, which in turn produces an electromotive force, or voltage, in the output coil. However, due to the effect of Lenz's Law, the amount of output power produced by typical power converters does not exceed the amount of input power. Accordingly, a power converter which mitigates the effect of Lenz's Law on the input coils is desired.

Based on a standard demagnetization curve for permanent magnets, the flux density of the permanent magnet remains relatively constant until a magnetizing force sufficient to coerce the magnet is applied to the magnet, at which point the magnetic flux density drops quickly to zero. Thus, the permanent magnet acts as a constant magnetic flux generator until coerced. Furthermore, a variation of Kirchoff's current law states that magnetic flux in a series loop is constant. Therefore, the present disclosure sets forth an application of these principles wherein a permanent magnet is used to mitigate the effect of Lenz's Law in a power converter.

Embodiments of the present disclosure generally pertain to a magnetic power converter. A magnetic power converter in accordance with an exemplary embodiment of the present disclosure comprises a generally figure-8 shaped magnetic core having a plurality of legs. A toroid is positioned along at least one leg of the core and a permanent magnet is positioned along at least one leg of the core to provide a plurality of magnetic flux paths through the core, forming a balanced reluctance bridge. An output coil is positioned around one leg of the core, and at least one input coil is positioned around a portion of each toroid. When current is driven through the input coil, a control flux is induced in each toroid which remains captured in the toroid, increasing the flux density in the toroid and lowering the permeability of the core such that a virtual air gap is formed in each toroid. Such control flux in the toroid displaces the magnetic flux produced by the permanent magnet such that a portion of the magnetic flux from the permanent magnet flows through the third leg of the core.

The change in magnetic flux flowing through the third leg induces a current in the output coil which may be used to provide electrical power to a load. Thus, the control core acts as a variable reluctance shunt with respect to the magnet and the flow of electricity and none of the energy moderating the flux through the toroid is coupled to the output coil. Accordingly, the output coil is controlled by the input coils indirectly and the effect of Lenz's Law on the input coils is mitigated. Due to the absence of the effect of Lenz's Law on the input coils, any output loading is not reflected on the input. The output power may therefore be greater than the input power. Because of this ability to amplify input power, embodiments of the present disclosure may have wide applications in alternative energy and green energy generation.

BRIEF DESCRIPTION OF THE DRAWINGS

The present disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

Figure 1:
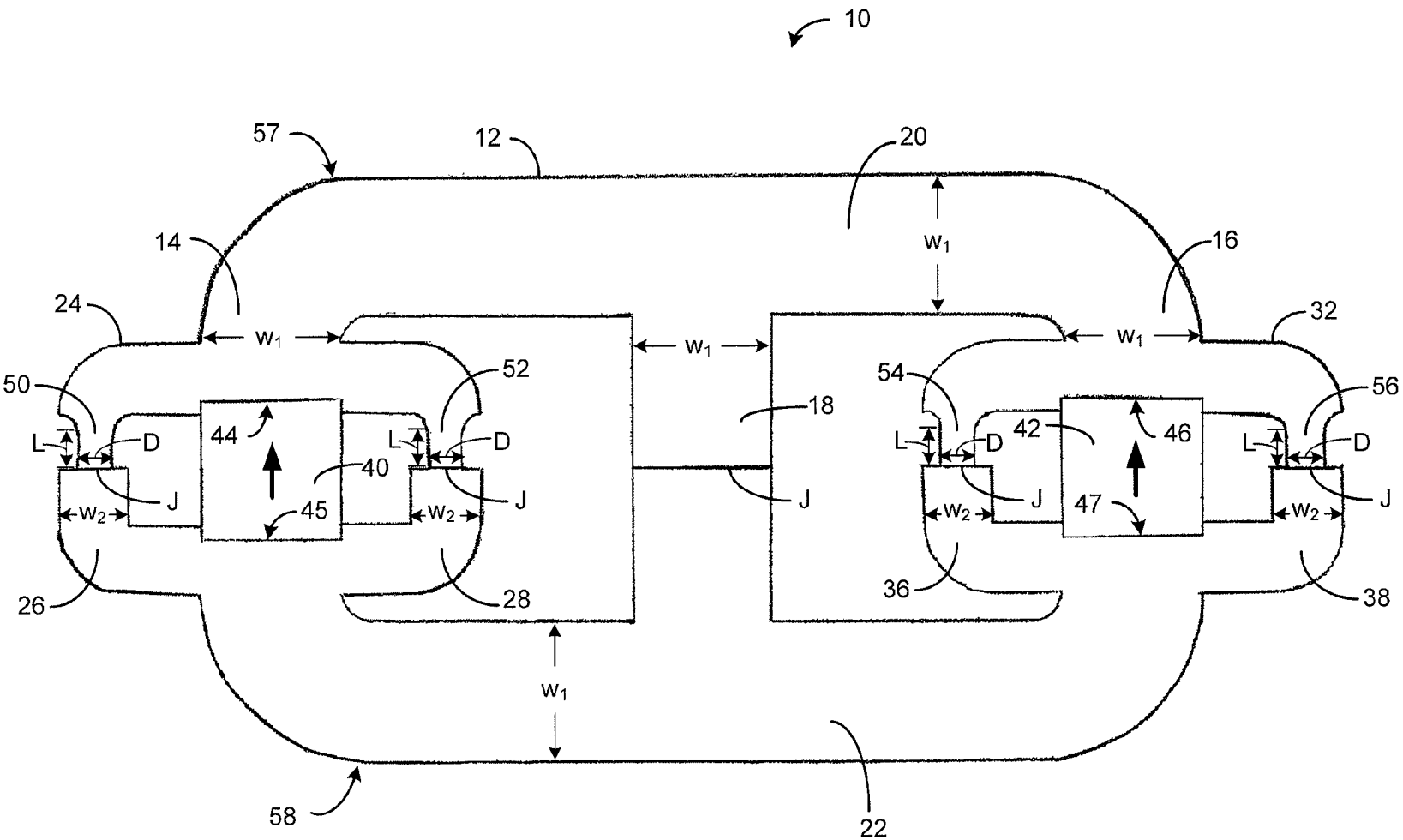
FIG. 1 is a top plan view of a magnetic power converter according to an exemplary embodiment of the present disclosure.

FIG. 1 is a top plan view of a magnetic power converter 10 according to an exemplary embodiment of the present disclosure. As shown by FIG. 1, the magnetic power converter 10 comprises a generally figure-8 shaped magnetic core 12 having a plurality of legs and a plurality of transverse pieces. In one embodiment, the core 12 comprises one-inch thick stack of 29 gauge M19 electrical steel laminations having a C5 oxide coating. However, other isotropic steels, such as, for example, M14 electrical steel, of varying thicknesses may be utilized in the core 12 in other embodiments.

In one embodiment, the core 12 has a left leg 14, a right leg 16, a middle leg 18, an upper transverse piece 20 and a lower transverse piece 22. The widths ($w_1$) of the left leg 14, the right leg 16, the middle leg 18, the upper transverse piece 20 and the lower transverse piece 22 are substantially equal. In one embodiment, such widths ($w_1$) are approximately one inch, although other widths are possible in other embodiments.

The upper transverse piece 20 is substantially parallel to the lower transverse piece 22. The left leg 14, right leg 16, and middle leg 18 are substantially parallel to one another and are substantially perpendicular to the upper transverse piece 20 and the lower transverse piece 22. Further, the upper transverse piece 20, the lower transverse piece 22, the left leg 14, the right leg 16, and the middle leg 18 are disposed in substantially the same plane.

The left leg 14 comprises a toroid 24 having a left portion 26 and a right portion 28, and the right leg 16 comprises a toroid 32 having a left portion 36 and a right portion 38. The left portion 26 and the right portion 28 lie in substantially the same plane as the left leg 14. In the embodiment depicted by FIG. 1, note that the core 12 is substantially symmetrical such that the orientation and dimensions of the core 12 mirror one another with respect to the middle leg 18. Also note that the toroid 24 is substantially the same size as the toroid 32, and each toroid 24 and 32 is symmetrical such that the respective left and right portions 26, 28, 36, and 38 mirror one another with respect to the corresponding leg 14 and 16. Furthermore, the widths ($w_2$) of the left portions 26 and 36 and the right portions 28 and 38 are substantially equal. For example, in one embodiment the width ($w_2$) of each left portion 26 and 36 and each right portion 28 and 38 is one-half (0.5) inches, although other widths are possible in other embodiments.

The left leg 14 further comprises a permanent magnet 40 positioned within the toroid 24, and the right leg 16 further comprises a permanent magnet 42 positioned within the toroid 32. The permanent magnets 40 and 42 induce magnetic flux through the core 12. The permanent magnets 40 and 42 are oriented in the same direction such that the respective north poles 44 and 46 of the magnets 40 and 42 are oriented towards the upper transverse piece 20. In one embodiment, the magnets 40 and 42 are in line with the left leg 14 and the right leg 16, respectively, and are the same width ($w_1$) as the legs 14 and 16. However, the magnets 40 and 42 may have different dimensions in other embodiments. In one embodiment, the permanent magnets 40 and 42 comprise rare earth magnets, such as, for example, neodymium iron boron magnets, but other types of permanent magnets 40 and 42 may be used in other embodiments. It is well-known that the permanent magnets 40 and 42 have stored potential energy (typically referred to as the "magnetic energy product") which is measured in megagauss-oersteds (MGOe), discussed in more detail hereafter, and represents the amount of energy the magnets 40 and 42 can supply to a magnetic circuit. One MGOe is equivalent to approximately 7957.75 Joules per cubic meter ($J/m^3$). In one embodiment, the magnetic energy product of the neodymium iron boron permanent magnets 40 and 42 is fifty-two (52) MGOe, or approximately $4.13803\times 10^5$ $J/m^3$.

The left portion 26 of the toroid 24 comprises a pinch point 50 wherein the left portion 26 of the toroid 24 becomes narrow, and the right portion 28 of the toroid 24 also comprises a pinch point 52. Similarly, the left portion 36 and the right portion 38 of the toroid 32 comprise pinch points 54 and 56, respectively. In one embodiment, a ratio of the length (L) of each pinch point 50, 52, 54, 56 to the corresponding depth (D) of the pinch point 50, 52, 54, 56 along that length is 0.8:1. For example, in one embodiment, the length (L) of the pinch point 50 is 0.2 inches and the depth (D) of the pinch point 50 is 0.25 inches. However, other ratios involving different lengths and different depths are possible in other embodiments.

In the embodiment depicted by FIG. 1, the core 12 comprises an upper section 57 and a lower section 58. The upper section 57 comprises the upper transverse piece 20 and the upper half of the toroid 24, the upper half of the middle leg 18, and the upper half of the toroid 32. Note that the pinch points 50, 52, 54, 56 are located in the upper section 57 in the embodiment depicted by FIG. 1 but they may be located in the lower section 58 in other embodiments. The lower section 58 comprises the lower transverse piece 22, the lower half of the toroid 24, the lower half of the middle leg 18, and the lower half of the toroid 32. The upper section 57 abuts the lower section 58 with a plurality of precision ground butt joints (J), as shown by FIG. 1, which allow for easy assembly. However, other types of joints are possible in other embodiments.

Figures 2, 2A:
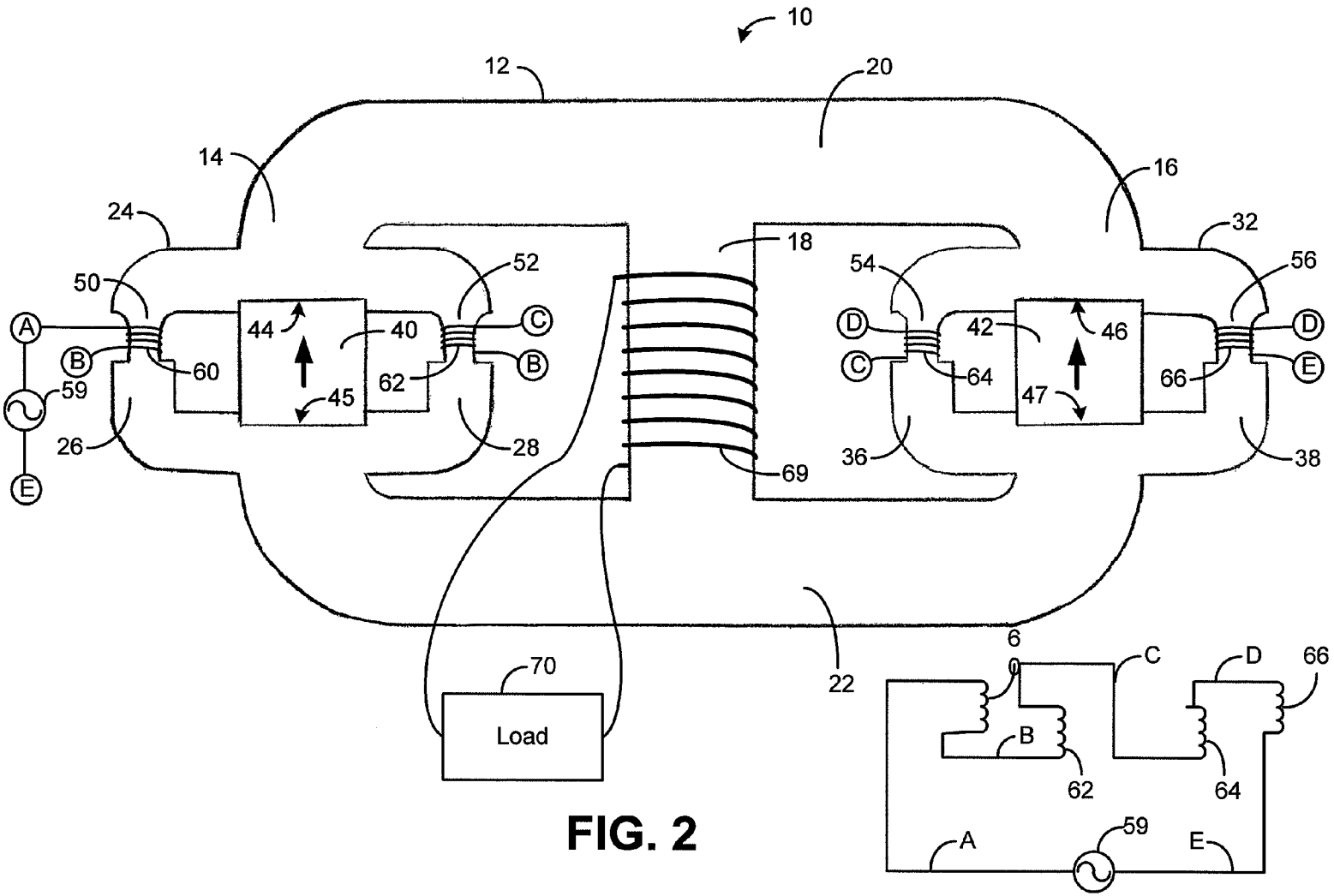
FIG. 2 depicts the magnetic power converter of FIG. 1 illustrating input and output coils.
FIG. 2A depicts the input coils of FIG. 2 coupled in series to the power source of FIG. 2.

FIG. 2 depicts the magnetic power converter 10 of FIG. 1 having a plurality of input coils and an output coil positioned around the core 12. As shown by FIG. 2, the magnetic power converter 10 further comprises an input coil 60, 62, 64, 66 positioned around each pinch point 50, 52, 54, 56, respectively. In one embodiment, each input coil 60, 62, 64, 66 is wound around a bobbin (not shown) comprising insulative material, such as, for example, polyoxymethylene plastic (Delrin®). [Note, therefore, that the input coils 60, 62, 64, 66 as shown in FIG. 2 are schematic representations of the coils, and do not depict the actual physical topography of the coils.] The bobbins (not shown) are positioned such that the coils 60, 62, 64, 66 are positioned around the corresponding pinch points 50, 52, 54, 56, respectively. The input coils 60, 62, 64, 66 are connected in series to an AC power source 59, as is depicted by FIG. 2A. The power source 59 is configured to provide electrical current to the input coils 60, 62, 64, 66. In one embodiment, the power source 59 provides a bipolar sine wave input signal. When the power source 59 sends an input signal to the coils 60, 62, 64, 66, electrical current flows through the coils 60, 62, 64, 66 and induces a magnetic flux in each toroid 24 and 32; however, no electrical current flows through the coils 60, 62, 64, 66 when no input signal is sent by the power source 59. The input coils 60, 62, 64, 66 are configured to generate a magnetic flux in the core 12 when an electrical current passes through the coils 60, 62, 64, 66 (i.e. when the power source 59 provides an input signal). In one embodiment, the input coil 60 and the input coil 64 are positioned such that the electromagnetic polarity of each coil 60 and 64 is oriented towards the lower transverse piece 22, while the input coil 62 and the input coil 66 are positioned such that the electromagnetic polarity of each coil 62 and 66 is oriented towards the upper transverse piece 20. Thus, the input coils 60 and 62 of the toroid 24 are oriented in opposite directions and the input coils 64 and 66 of the toroid 32 are oriented in opposite directions. Such orientations are significant for demonstrating that the placement of the permanent magnets 40 and 42 mitigate the effect of Lenz's Law on the input coils 60, 62, 64, 66, discussed in more detail hereafter. However, the input coils 60, 62, 64, and 66 may be oriented in the same direction in other embodiments.

In one embodiment, each input coil 60, 62, 64, 66 comprises insulated multifurcate wiring, such as, for example, twenty-two strands of number thirty-six (36) copper wire. Such multifurcate wiring reduces the overall resistance of the coils 60, 62, 64, 66 while keeping the impedance of the coils 60, 62, 64, 66 low, increasing the total power output of the magnetic power converter 10. Other types of insulated multifurcate wiring are possible in other embodiments. In one embodiment, each of the coils 60, 62, 64, 66 has 105 turns and a resistance of 0.76 Ohms (a), although different resistances and numbers of turns may be utilized in other embodiments.

The magnetic power converter 10 further comprises an output coil 69 positioned around the middle leg 18 of the core 12. When a change in magnetic flux traveling through middle leg 18 occurs, an electromotive force is induced in the output coil 69 causing the output coil 69 to generate electrical power to a load 70, described in more detail hereafter. The output coil 69 comprises insulated multifurcate wiring. In one embodiment, the output coil 69 comprises a dual coil having sixteen strands of number thirty-two (32) copper wire. Furthermore, the coil has six hundred (600) turns and a length of 5.08 centimeters (cm) in this embodiment, but different types of coils having more or fewer turns and varying lengths are possible in other embodiments. In one embodiment, the middle leg 18 of the core 12 is one inch wide, although the middle leg 18 may be narrower in other embodiments.

In one exemplary embodiment, the core 12 comprises M19 electrical steel and the permanent magnets 40 and 42 comprise neodymium iron boron magnets having a magnetic energy product of 52 MGOe. The length of each pinch point 50, 52, 54, 56 is 0.2 inches and the depth of each pinch point 50, 52, 54, 56 is 0.25 inches. Also, each input coil 60, 62, 64, 66 comprises twenty-two (22) strands of number thirty-six (36) copper wire having one hundred five (105) turns and a resistance of 0.76Ω, and the output coil 69 comprises sixteen (16) strands of number thirty-two (32) copper wire having six hundred (600) turns. Furthermore, the coils 60 and 62 are oriented in opposite directions and the coils 64 and 66 are oriented in opposite directions. Finally, no input signal is provided by the power source 59.

Figure 3:
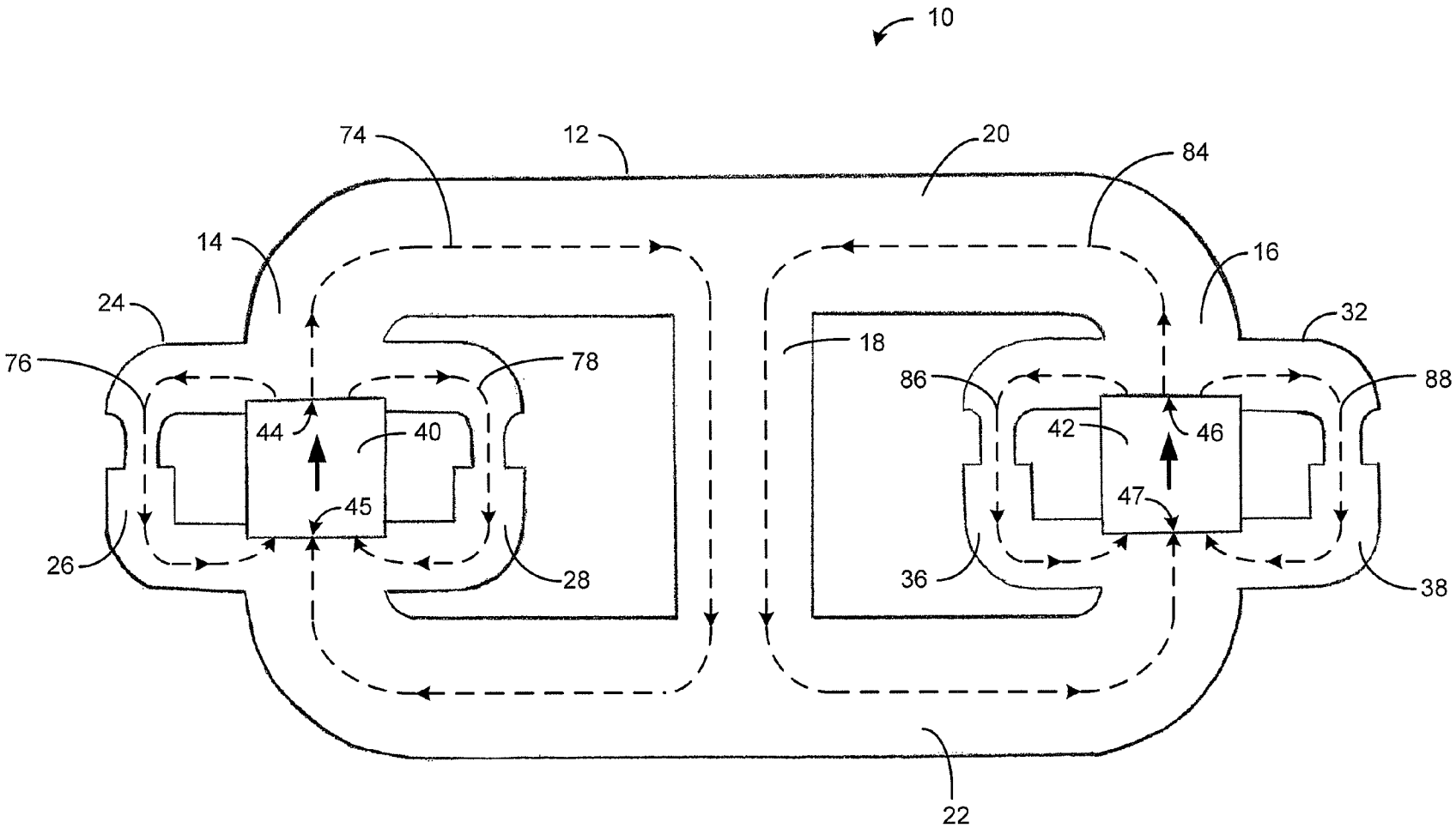
FIG. 3 depicts magnetic flux paths within the magnetic power converter of FIG. 2 when no current flow through the input coils.

FIG. 3 illustrates magnetic flux produced by the permanent magnets 40 and 42 when no input power is applied to the core 12. The magnetic flux travels through the core 12 along a plurality of magnetic flux paths 74, 76, and 78. The magnetic flux path 74 moves away from the north pole 44 of the magnet 40 and up the left leg 14 to the upper transverse piece 20. The magnetic flux path 74 further travels along the upper transverse piece 20 and down the middle leg 18 to the lower transverse piece 22. The magnetic flux path 74 further travels along the lower transverse piece 22 towards the left leg 14 and up the left leg 14 to the south pole 45 of the magnet 40. Approximately half of the magnetic flux produced by the magnet 40 travels along the magnetic flux path 74 when no input signal is provided by the power source 59 (FIG. 2). The magnetic flux path 76 travels in a counter-clockwise direction away from the north pole 44 of the magnet 40, through the left portion 26 of the toroid 24, and back to the south pole 45 of the magnet 40. Similarly, the magnetic flux path 78 travels in a clockwise direction away from the north pole 44 of the magnet 40, through the right portion 28 of the toroid 24, and back to the south pole 45 of the magnet 40. Approximately one-fourth of the magnetic flux produced by the magnet 40 flows through the magnetic flux path 76 and approximately one-fourth of the magnetic flux produced by the magnet 40 flows through the magnetic flux path 78 when no input signal is provided by the power source 59.

The permanent magnet 42 produces magnetic flux which travels through the core 12 along a plurality of magnetic flux paths 84, 86, and 88. When no input signal is provided by the power source 59, the magnetic flux path 84 moves away from the north pole 46 of the magnet 42, up the right leg 16 to the upper transverse piece 20, and along the upper transverse piece 20 to the middle leg 18. The magnetic flux path 84 then travels down the middle leg 18 to the lower transverse piece 22, along the lower transverse piece 22 to the right leg 16, and up the right leg 16 to the south pole 47 of the magnet 42. The magnetic flux path 86 travels away from the north pole 46 of the magnet 42 in a counter-clockwise direction through the left portion 36 of the toroid 32 and back to the south pole 47 of the magnet 42. The magnetic flux path 88 travels in a clockwise direction from the north pole 46 of the magnet 42, through the right portion 38 of the toroid 32, and back to the south pole 46 of the magnet 42. When no input signal is provided by the power source 59, approximately half of the magnetic flux produced by the magnet 42 travels along the magnetic flux path 84, approximately one-fourth of the magnetic flux produced by the magnet 42 travels along the magnetic flux path 86, and approximately one-fourth of the magnetic flux produced by the magnet 42 travels along the magnetic flux path 88. Thus, the permanent magnets 40 and 42 produce a constant magnetic flux which is distributed evenly throughout the core 12 when no input signal is provided by the power source 59.

In the exemplary embodiment discussed above, the magnetic flux density ($B_m$) in each pinch point 50, 52, 54, 56 is approximately 15 kilogauss (KG) and the magnetic flux density ($B_m$) in the middle leg 18 is approximately 9 KG when no electrical current flows through the coils 60, 62, 64, 66.

When the power source 59 provides an input signal to the input coils 60, 62, 64, 66 (FIG. 2), electrical current flows through the input coils 60, 62, 64, 66. It is well-known in the art that a variation of the formula for calculating electrical power is:

$$P=I^2R$$

where P is power, I is current, and R is resistance. Thus, when electrical current flows through the coils 60, 62, 64, 66, the total input power ($P_{in}$) is defined by the equation:

$$P_{in}=I_{in}^2R_{in}$$

where $I_{in}$ is the input current and $R_{in}$ is the total input resistance. Thus, if the input current is 980 milliamps (mA) and the total input resistance of the input coils 60, 62, 64, 66 is 3.04 Ohms (Ω), the input power ($P_{in}$) is set forth as $$P_{in}=(980\text{ mA})^2\times(3.04\Omega).$$

Therefore, $P_{in}$ equals approximately 2.92 Watts (W).

Figure 4:
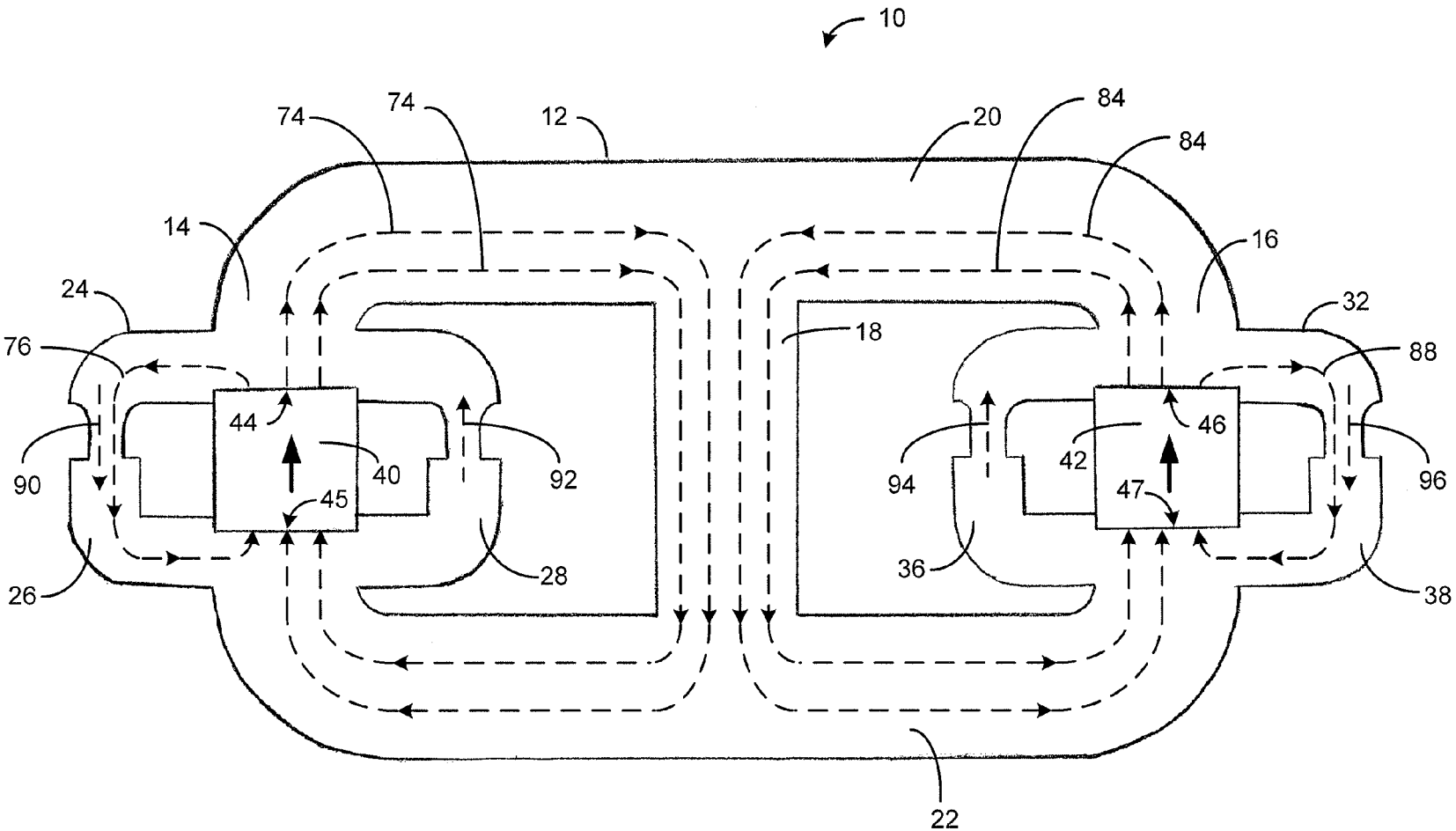
FIG. 4 depicts magnetic flux paths within the magnetic power converter of FIG. 2 when current flows through the input coils.

FIG. 4 illustrates flux flowing through the core 12 when input power is applied to the core 12. When current flows through the coil 60 (FIG. 2), a control flux 90 is induced in the pinch point 50 (FIG. 2) which travels in the same direction as the magnetic flux path 76. The magnetomotive force ($F_{c1}$) produced by the coil 60 is defined by the equation $$F_{c1}=0.4\pi N_{C1}I_{c1}$$

where $N_{c1}$ is the number of turns of the coil 60 and $I_{c1}$ is the current flowing through the coil 60. Thus, the magnetomotive force ($F_{c1}$) produced by the coil 60 is defined by the equation $$F_{c1}=(0.4\pi)\times(105)\times(0.980\text{ A})$$

which equals approximately 129.3 gilberts (Gi). The magnetizing force produced by the coil 60 is set forth by the equation $$H_{c1}=\frac{0.4\pi N_{c1}I_{c1}}{L_{c1}}$$

where $N_{c1}$ is the number of turns (105), $I_{c1}$ is the current through the coil 60 (0.980 A), and $L_{c1}$ is the length of the coil 60 (0.508 centimeters (cm)). Therefore, $H_{c1}$ equals approximately 254.54 oersteds (Oe).

Figure 5:
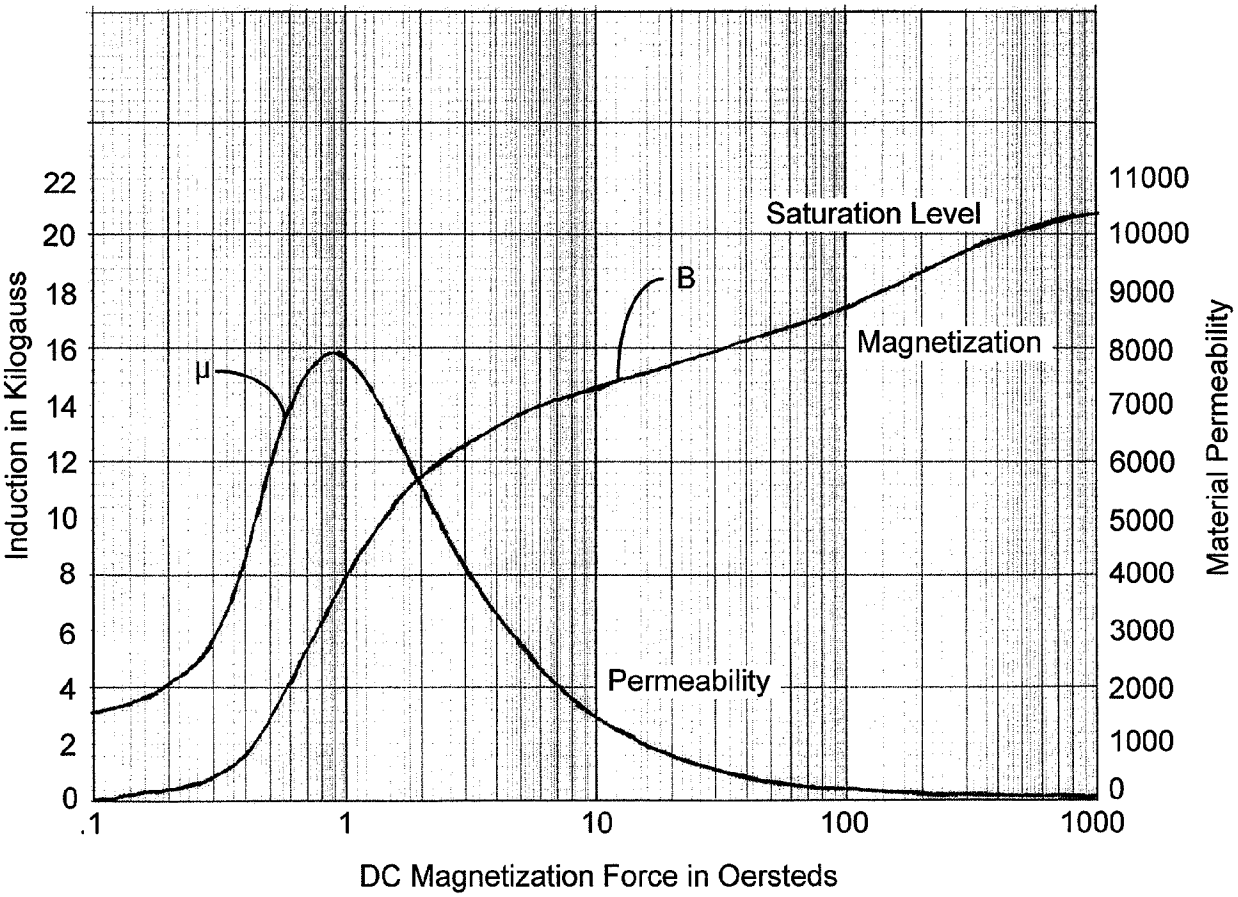
FIG. 5 is a chart relating a B-H curve for M19 electrical steel to permeability.

FIG. 5 depicts a B-H curve for M19 electrical steel illustrating the relationship between permeability, magnetic flux density, and magnetizing force. The control flux 90 ($\Phi_{c1}$) induced by the coil 60 is defined by the equation $$\Phi_{c1}=B_{c1}A$$

where $B_{c1}$ is the magnetic flux density through the pinch point 50 in KG, and A is the cross-sectional area of the core 12 through the pinch point 50 in square centimeters (1.6129 $cm^2$). In one embodiment, when 980 mA of current flows through the coil 60, the magnetic flux density ($B_{c1}$) through the pinch point 50 equals approximately 19.3 KG. Thus, $\Phi_{c1}$ is approximately equal to 31,937.4 maxwells (Mx).

The strong control flux 90 and the permanent magnet (PM) magnetic flux of the magnetic flux path 76 traveling in the same direction within the pinch point 50 cause the magnetic flux density in the pinch point 50 to increase such that the left portion 26 of the toroid 24 is driven to saturation. Referring to FIG. 5, as the magnetizing force (H) applied to the M19 electrical steel increases, the magnetic flux density (B) increases significantly until the steel approaches saturation, at which point the permeability decreases drastically. Thus, when the magnetic flux density ($B_{c1}$) through the pinch point 50 equals approximately 19.3 KG, the relative permeability (μ) approaches zero.

The relationship between reluctance (R) and permeability (μ) is defined as $$R=\frac{L}{\mu A}$$

where L is the length of the magnetic path in centimeters (cm) and A is the cross-sectional area of the core 12 in square centimeters ($cm^2$). Thus, as the permeability decreases the reluctance increases greatly. Furthermore, as the cross-sectional area of the core 12 decreases the reluctance increases. Therefore, the combination of the small cross-sectional area (A) of the pinch point 50 and the low permeability (μ) in the pinch point 50 causes a significant increase in reluctance (R) in the pinch point 50. Accordingly, at saturation, the reluctance in the left portion 26 is high such that further PM magnetic flux cannot enter the left portion 26 of the toroid 24. Such low permeability creates a virtual air gap which causes a significant amount of the magnetic flux of the PM magnetic flux path 76 to flow through the magnetic flux path 74.

Furthermore, as shown by FIG. 4, when current flows through the coil 62 (FIG. 2), a control flux 92 is induced in the pinch point 52 (FIG. 2) which opposes the magnetic flux of the magnetic flux path 78. The control flux 92 ($\Phi_{c2}$) is generally the same magnitude as the control flux 90, which is 31,937.4 Mx. The magnetomotive force ($F_{c2}$), the magnetizing force ($H_{c2}$), and the magnetic flux density ($B_{c2}$) introduced by the coil 62 are also equal in magnitude to $F_{c1}$, $H_{c1}$, and $B_{c1}$, respectively, but in an opposite direction with respect to the permanent magnet 40. The control flux 92 opposes the magnetic flux in the pinch point 52, lowering the permeability in the right portion 28 of the toroid 24 such that no flux travels through the right portion 28 and the magnetic flux density through the pinch point 52 becomes zero. Such a low permeability in the right portion 38 of the toroid 24 causes a high reluctance in the right portion 38, creating a virtual air gap which diverts a significant amount of PM magnetic flux from the magnetic flux path 78 to the magnetic flux path 74. A combination of the left portion 26 of the toroid 24 being driven to saturation and the right portion 28 of the toroid 24 allowing no flux to flow through the magnetic flux path 78 creates a high reluctance in the toroid 24, causing a high percentage of the PM magnetic flux from the magnet 40 traveling along the magnetic flux path 76 and the magnetic flux path 78 to be displaced such that the PM magnetic flux now travels along the magnetic flux path 74 through the middle leg 18. Such an increase in magnetic flux traveling through the middle leg 18 induces an electromotive force in the output coil 69 (FIG. 2), which may be used to power the load 70 (FIG. 2).

Similarly, when current flows through the coil 64 (FIG. 2), a control flux 94 is induced in the pinch point 54 (FIG. 2) which opposes the PM magnetic flux of the magnetic flux path 86. The magnitude of the control flux 94 is equal to approximately 31,937.4 Mx, as discussed above with respect to the control flux 90 and 92. Furthermore, the magnetomotive force ($F_{c3}$), the magnetizing force ($H_{c3}$), and the magnetic flux density ($B_{c3}$) introduced by the coil 64 are also equal in magnitude to $F_{c1}$, $H_{c1}$, and $B_{c1}$, respectively. The control flux 92 opposes the PM magnetic flux of the magnetic flux path 86, lowering the permeability of the pinch point 54 and creating a virtual air gap such that no magnetic flux flows through the left portion 36 of the toroid 32. Thus, the magnetic flux density in the left portion 36 becomes zero. Accordingly, the PM magnetic flux is diverted from the magnetic flux path 86 to the magnetic flux path 84.

When current flows through the coil 66 (FIG. 2), a control flux 96 is induced in the pinch point 56 (FIG. 2) which travels in the same direction as the magnetic flux of the magnetic flux path 88. The magnitude of the control flux 96 is also approximately 31,937.4 Mx, as discussed above with respect to the control flux 90, 92, and 94. The magnetomotive force ($F_{c4}$), the magnetizing force ($H_{c4}$), and the magnetic flux density ($B_{c4}$) introduced by the coil 66 are also equal in magnitude to $F_{c1}$, $H_{c1}$, and $B_{c1}$, respectively. A combination of the control flux 96 and the magnetic flux of the magnetic flux path 88 flowing through the pinch point 56 causes the magnetic flux density in the pinch point 56 to increase until it reaches saturation. In one embodiment, the magnetic flux density in the pinch point 56 rises to 19.3 KG. Thus, the permeability of the pinch point 56 becomes low and the reluctance becomes high, creating a virtual air gap which causes the magnetic flux of the magnetic flux path 88 to flow through the magnetic flux path 84.

When the magnetic flux from the magnetic flux paths 76, 78, 86, 88 is diverted through the magnetic flux paths 74 and 84, the magnetic flux flowing through the middle leg 18 increases significantly. According to Faraday's Law of induction, the induced electromotive force in any closed circuit is equal to the time rate of change of the magnetic flux through the circuit. Thus, the change in the magnetic flux traveling through the middle leg 18 induces an electromotive force in the output coil 69, thereby converting the potential magnetic energy of the magnets 40 and 42 into kinetic electrical energy which may be used to provide electrical power to a load 70. In one embodiment, the output signal resembles a full wave rectified sine wave which is twice the frequency of the input signal. Such an output signal shows that the output signal is indirectly controlled by the input signal, i.e., the output signal is not coupled to the input.

According to Lenz's Law, the polarity of the electromotive force induced in the output coil 69 (FIG. 2) by a magnetic flux is such that it produces a current whose magnetic field, or magnetizing force, opposes the original change in flux. Thus, the induced current in the output coil 69 has a magnetizing force which opposes the flux flowing through the middle leg 18.

The total magnetizing force ($H_{1TOTAL}$) produced by the input coils 60 and 62 and the magnet 40 is set forth in the equation $$H_{1TOTAL}=H_{m1}+H_{c1}+H_{c2}$$

where $H_{m1}$ is the magnetizing force produced by the magnet 40, $H_{c1}$ is the magnetizing force produced by the input coil 60, and $H_{c2}$ is the magnetizing force produced by the input coil 62. Similarly, the total magnetizing force ($H_{2TOTAL}$) produced by the input coils 64 and 66 and the permanent magnet 42 is set forth in the equation $$H_{2TOTAL}=H_{m2}+H_{c3}+H_{c4}$$

where $H_{m2}$ is the magnetizing force produced by the magnet 42, $H_{c3}$ is the magnetizing force produced by the input coil 64, and $H_{c4}$ is the magnetizing force produced by the input coil 66.

It is significant to note that the polarity of the input coil 60 and the polarity of the input coil 62 are in opposition to one another with respect to the output coil 69, and the polarity of the input coil 64 and the polarity of the input coil 66 are also in opposition to one another with respect to the output coil 69. Thus, $$H_{1TOTAL}=H_{m1}+H_{c1}-H_{c2}$$

and $$H_{2TOTAL}=H_{m2}+H_{c3}+H_{c4}.$$

Therefore, $H_{c1}$ and $H_{c2}$ cancel one another out and $H_{c3}$ and $H_{c4}$ cancel one another out with respect to the output coil 69 such that $$H_{1TOTAL}=H_{m1}$$

and $$H_{2TOTAL}=H_{m2}.$$

Accordingly, the magnetizing force produced by the current in the output coil 69 only opposes the flux from the magnets 40 and 42 and does not affect the input coils 60, 62, 64, 66 since polarities of the input coils 60 and 62 and the input coils 64 and 66 are in opposition to one another with respect to the output coil 69. Such orientation demonstrates that the input coils 60, 62, 64, 66 indirectly control the output and are immune from the effect of Lenz's Law.

Furthermore, the standard equation for the transformer is $$E_{out}=\frac{4.44 f N_{out} B_m A}{10^8}$$

where $E_{out}$ is the electromotive force in the output coil 69, $N_{out}$ is the frequency, $N_{out}$ is the number of turns of the output coil 69, $B_m$ is the magnetic flux density, and A is the cross-sectional area in $cm^2$. The standard equation for the magnetizing force of the output coil 69

$$H_{out}=\frac{0.4\pi N_{out} I_{out}}{L_{out}}$$

where $N_{out}$ is the number of turns of the output coil 69, $I_{out}$ is the current through the coil 69, and $L_{out}$ is the length of the coil 69. Note that frequency is a component of the standard equation for the transformer but is not a component of the standard equation for magnetizing force. Thus, by increasing the frequency and maintaining the current flowing through the input coils 60, 62, 64, 66, the electromotive force in the output coil 69 is increased, but the opposing magnetizing force produced by the output coil 69 remains the same.

Figure 6:
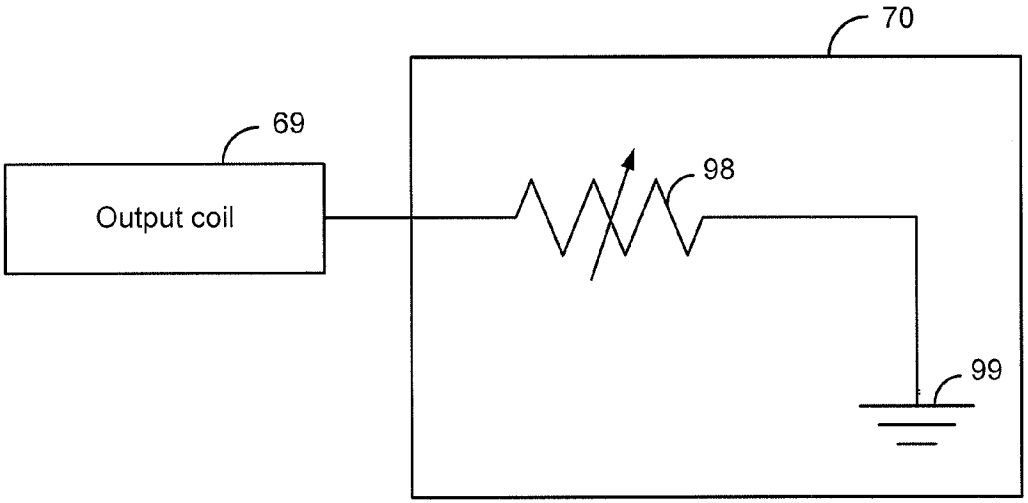
FIG. 6 is a schematic diagram depicts the load of FIG. 2 according to an exemplary embodiment of the present disclosure.

FIG. 6 is a schematic diagram depicting an exemplary embodiment of the load 70 of FIG. 2. In one embodiment, the load 70 comprises a variable resistor 98, such as, for example, a potentiometer, connected between the output coil 69 and ground 99. The maximum power output delivered to the load 70 is determined by adjusting the variable resistor 98 such that the voltage across the variable resistor 98 is equal to approximately half of the no load voltage. Once the voltage across the variable resistor 98 is half of the no load voltage, the load impedance matches the source impedance. According to the maximum power theorem, when the load impedance matches the source impedance, maximum power is transferred to the load 70.

Accordingly, when the voltage across the variable resistor 98 is half the no load voltage, the current flowing through the resistor is measured. The total power output is determined by the formula $$P_{out}=V_{out}I_{out}$$

where $P_{out}$ is the power output, $V_{out}$ is the voltage across the load 70, and $I_{out}$ is the current through the load 70. Thus, when the no load voltage is 64 V, the variable resistor 98 is adjusted until the load voltage is approximately 32 V. The current is then measured and multiplied by the load voltage to determine the power output ($P_{out}$).

Example I

Using the exemplary magnetic power converter 10 discussed above, a test was performed with the following parameters:

| Input Frequency (Hz) | Input Power (W) | Output Power (W) | Power Boost (%) |
|---|---|---|---|
| 60 | 3.155 | 2.940 | −6.8 |
| 70 | 3.079 | 3.011 | −2.2 |
| 80 | 3.079 | 3.054 | −0.8 |
| 90 | 3.082 | 3.130 | 1.5 |
| 100 | 3.053 | 3.180 | 4.2 |

Figure 7:
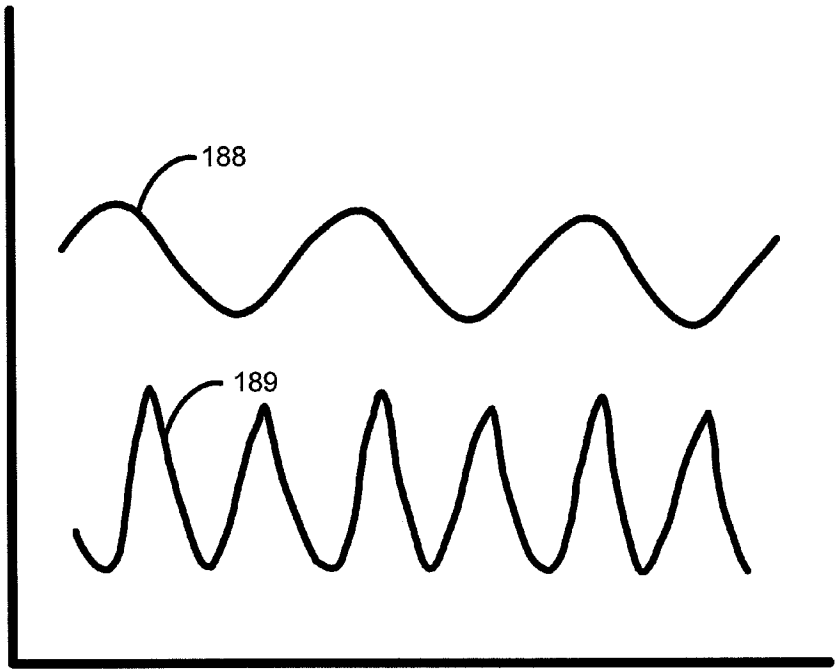
FIG. 7 depicts the input power signal and the output power signal in the test of Example I.

Accordingly, as the input frequency increased, the output power ($P_{out}$) increased with no corresponding increase to the input power ($P_{in}$). FIG. 7 depicts the input signal 188 applied in this test, a bipolar sine wave, and the output signal 189, which resembles a full wave rectified sine wave floating about a reference. Note that the output frequency is double that of the input.

Figure 8:
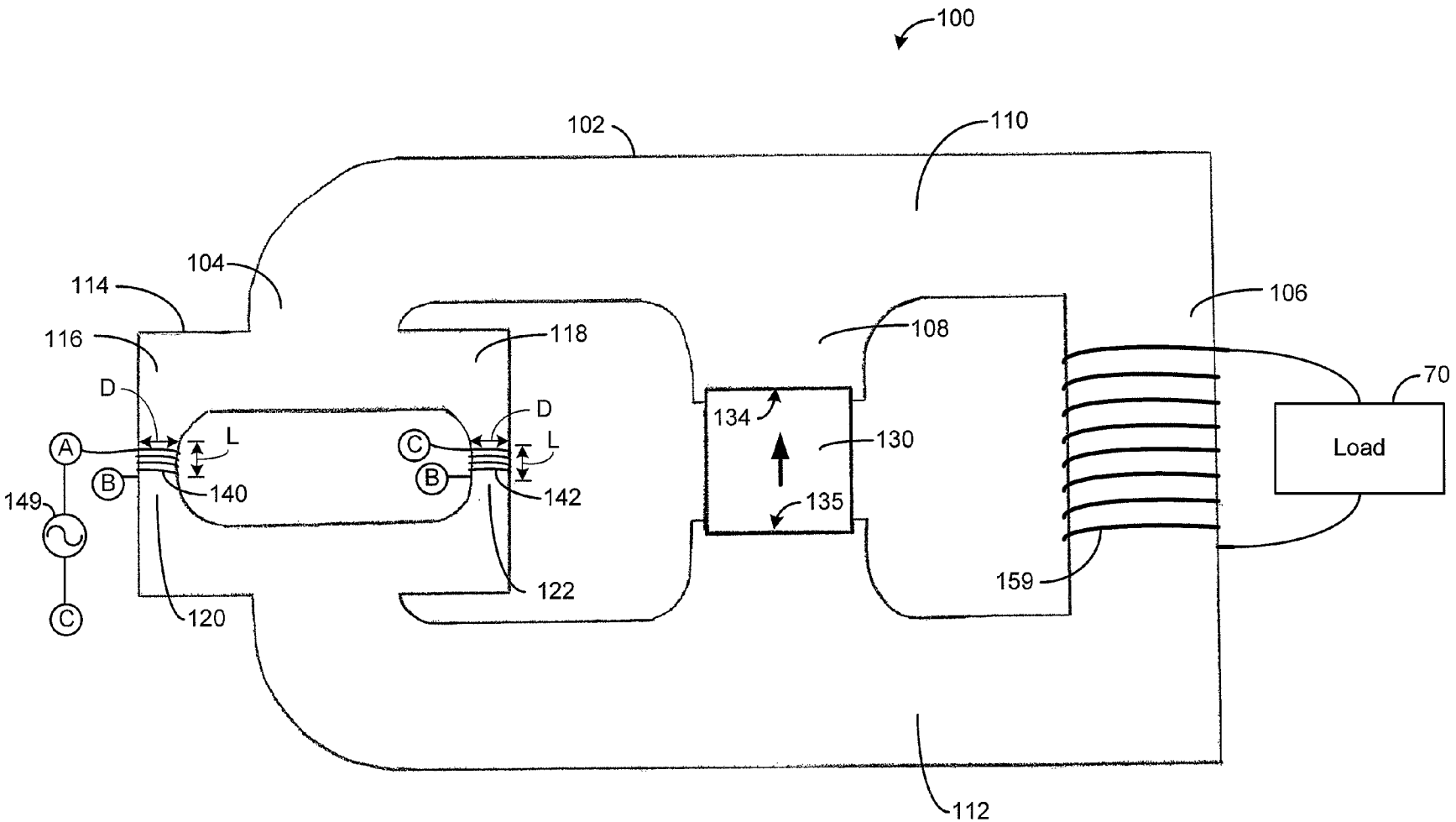
FIG. 8 depicts a magnetic power converter according to another exemplary embodiment of the present disclosure.

FIG. 8 depicts a magnetic power converter 100 according to another exemplary embodiment of the present disclosure. The magnetic power converter 100 comprises a generally figure-8 shaped core 102 comprising a left leg 104, a right leg 106, a middle leg 108, an upper transverse piece 110, and a lower transverse piece 112. The left leg 104, the right leg 106, and the middle leg 108 each extend from the upper transverse piece 110 to the lower transverse piece 112. In one embodiment, the core 102 comprises a one-inch thick stack of 29 gauge M19 electrical steel laminations, but other isotropic materials, such as M14 electrical steel, involving varying depths may be utilized in the core 102 in other embodiments. The left leg 104 comprises a toroid 114 having a left portion 116 and a right portion 118. The left portion 116 and the right portion 118 comprise pinch points 120 and 122, respectively, wherein the toroid 114 becomes narrow. In one embodiment, a ratio of the length (L) of each pinch point 120 and 122 to the corresponding depth (D) of each pinch point 120 and 122 along that length is 0.8:1. For example, in one embodiment, the length (L) of the pinch point 120 is 0.2 inches and the depth (D) of the pinch point 120 is 0.25 inches. However, other pinch point 120 and 122 ratios involving other lengths and depths are possible in other embodiments.

The middle leg 108 comprises a permanent magnet 130 positioned within the middle leg 108 such that the north pole 134 of the magnet 130 is oriented towards the upper transverse piece 110 and the south pole 135 of the magnet is oriented towards the lower transverse piece 112. The permanent magnet 130 provides a constant magnetic flux throughout the core 102. In one embodiment, the permanent magnet 130 comprises a neodymium-iron-boron magnet having a magnetic energy product of fifty-two (52) MGOe, although other types of permanent magnets 130 having varying magnetic energy products are possible in other embodiments. The right leg 106 comprises a uniform width between the upper transverse piece 110 and the lower transverse piece 112. In one embodiment, the right leg 106 is one inch wide, but other widths are possible in other embodiments.

The magnetic power converter 100 further comprises an input coil 140 positioned around the pinch point 120 and an input coil 142 positioned around the pinch point 122. Each input coil 140 and 142 is wound around a bobbin (not shown) comprising insulative material, such as, for example, polyoxymethylene plastic (Delrin®). The bobbins (not shown) are positioned such that the coils 140 and 142 are positioned around the corresponding pinch points 120 and 122, respectively. [Note, therefore, that the input coils 140 and 142 as shown in FIG. 8 are schematic representations of the coils, and do not depict the actual physical topography of the coils.] The input coil 140 is positioned such that the electromagnetic polarity of the coil 140 is oriented towards the lower transverse piece 112, and the input coil 142 is positioned such that the electromagnetic polarity of the coil 142 is oriented towards the upper transverse piece 110. The input coils 140 and 142 are connected in series to a power source 149. The power source 149 is configured to provide electrical current to the input coils 140 and 142. No electrical current flows through the coils 140 and 142 when no input signal is provided by the power source 149. However, electrical current flows through the coils 140 and 142 and induces a control flux, discussed in more detail hereafter, in the toroid 114 when an input signal is provided by the power source 149.

Each input coil 140 and 142 comprises insulated multifurcate wiring. In one embodiment, each input coil 140 and 142 comprises twenty-two strands of number thirty-six (36) copper wire. However, other types of wiring involving different numbers of strands are possible in other embodiments. In one embodiment, each of the coils 140 and 142 has 105 turns and a resistance of 0.76 Ohms (Ω), although different resistances and numbers of turns may be utilized in other embodiments.

The magnetic power converter 100 further comprises an output coil 159 positioned around the right leg 106. When a change in magnetic flux traveling through right leg 106 occurs, an electromotive force is induced in the output coil 159 causing the output coil 159 to generate electrical power to a load 70. The output coil 159 comprises insulated multifurcate wiring. In one embodiment, the output coil 159 comprises a dual coil having sixteen strands of number thirty-two (32) copper wire and six hundred (600) turns, but different types of coils having more or fewer turns are possible in other embodiments.

In one exemplary embodiment, assume that the core 102 comprises M19 electrical steel and the permanent magnet 130 is removed from the core 102. Further assume that the length of the pinch points 120 and 122 is 0.2 inches and the depth of the pinch points 120 and 122 is 0.25 inches. Also assume that each input coil 140 and 142 comprises twenty-two (22) strands of number thirty-six (36) copper wire having one hundred five (105) turns and a resistance of 0.76Ω, and that the output coil 159 comprises sixteen (16) strands of number thirty-two (32) copper wire having six hundred (600) turns. Furthermore, assume that the coils 140 and 142 are oriented in opposite directions with respect to the output coil 159. Finally, assume that an input signal is provided by the power source 149 such that the power source 149 provides 980 mA of current through the input coils 140 and 142.

Figure 9:
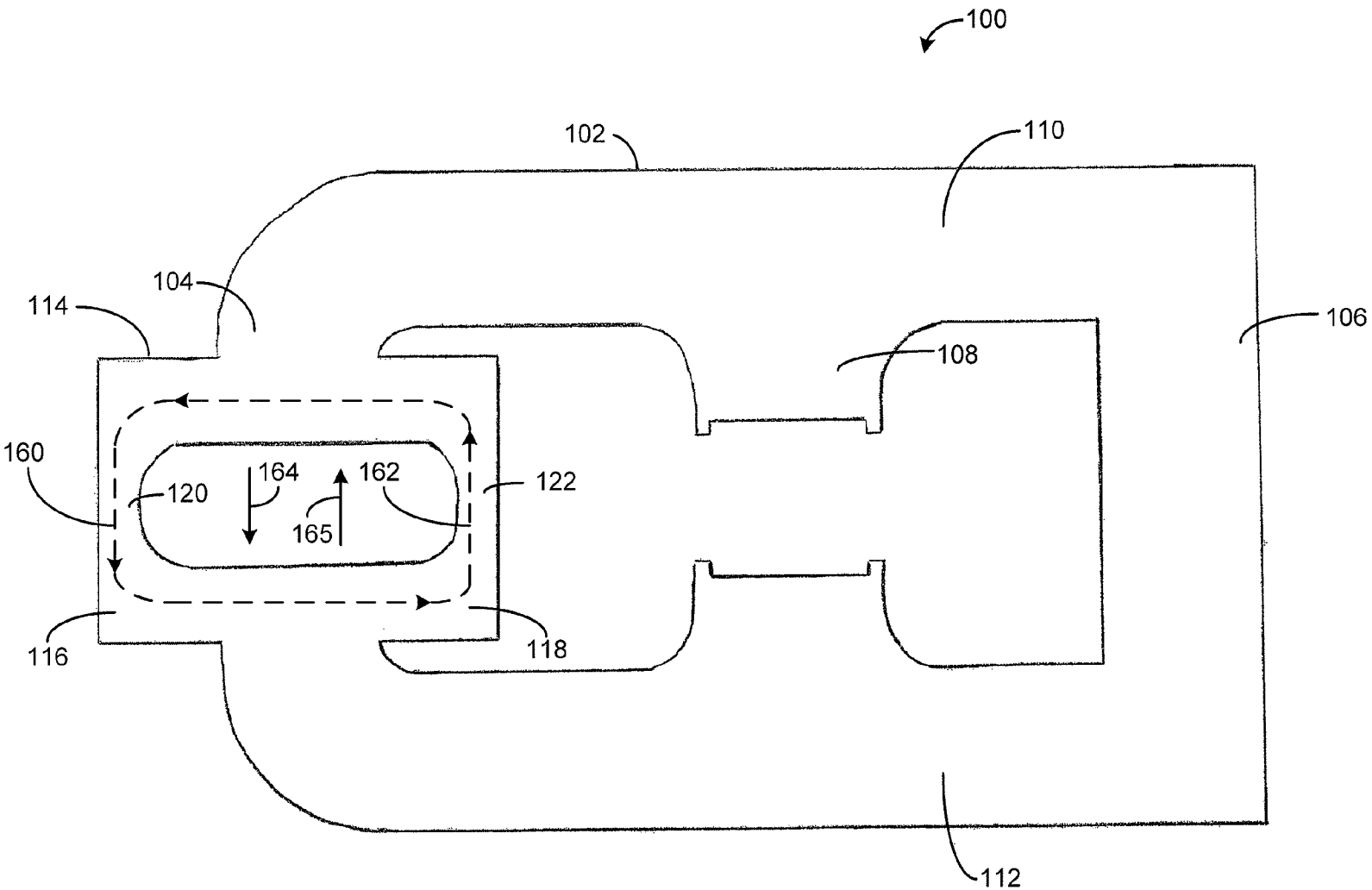
FIG. 9 depicts magnetic flux paths within the magnetic power converter of FIG. 8 when the magnet is removed and current flows through the input coils.

FIG. 9 depicts the control flux traveling through the toroid 114 if the permanent magnet 130 were removed from the core 12 and power source 149 (FIG. 8) were providing an input signal to the input coils 140 and 142. As shown by FIG. 9, when power source 149 provides an input signal, the input coil 140 (FIG. 8) induces a control flux 160 in the left portion 116 of the toroid 114. Due to the orientation of the coil 140, the control flux 160 travels down the left portion 116 in the direction indicated by directional arrow 164. Furthermore, the input coil 142 (FIG. 8) induces a control flux 162 in the right portion 118 of the toroid 114 which travels in the direction indicated by the directional arrow 165. Accordingly, the control flux 160 induced by the input coil 140 and the control flux 162 induced by the input coil 142 are in opposition to one another with respect to the output coil 159 (FIG. 8) but travel in the same circumferential direction within the toroid 114.

When the power source 149 provides an input signal, the control flux 160 and 162 induced by the input coils 140 and 142, respectively, thus travels in a counter-clockwise direction within the toroid 114. Importantly, as shown by FIG. 9, none of the control flux 160 and 162 escapes the toroid 114 to the right leg 106. Thus, the ability of the control flux 160 and 162 to remain captive within the toroid 114 demonstrates the magnetic isolation of the input coils 140 and 142 from the output coil 159, which is significant in indirectly controlling the output coil 159 and thereby mitigating the effect of Lenz's Law on the input coils 140 and 142. In other embodiments, the input coils 140 and 142 may be oriented in opposite directions such that they produce control flux which travels in a clockwise direction within the toroid 114.

Figure 10:
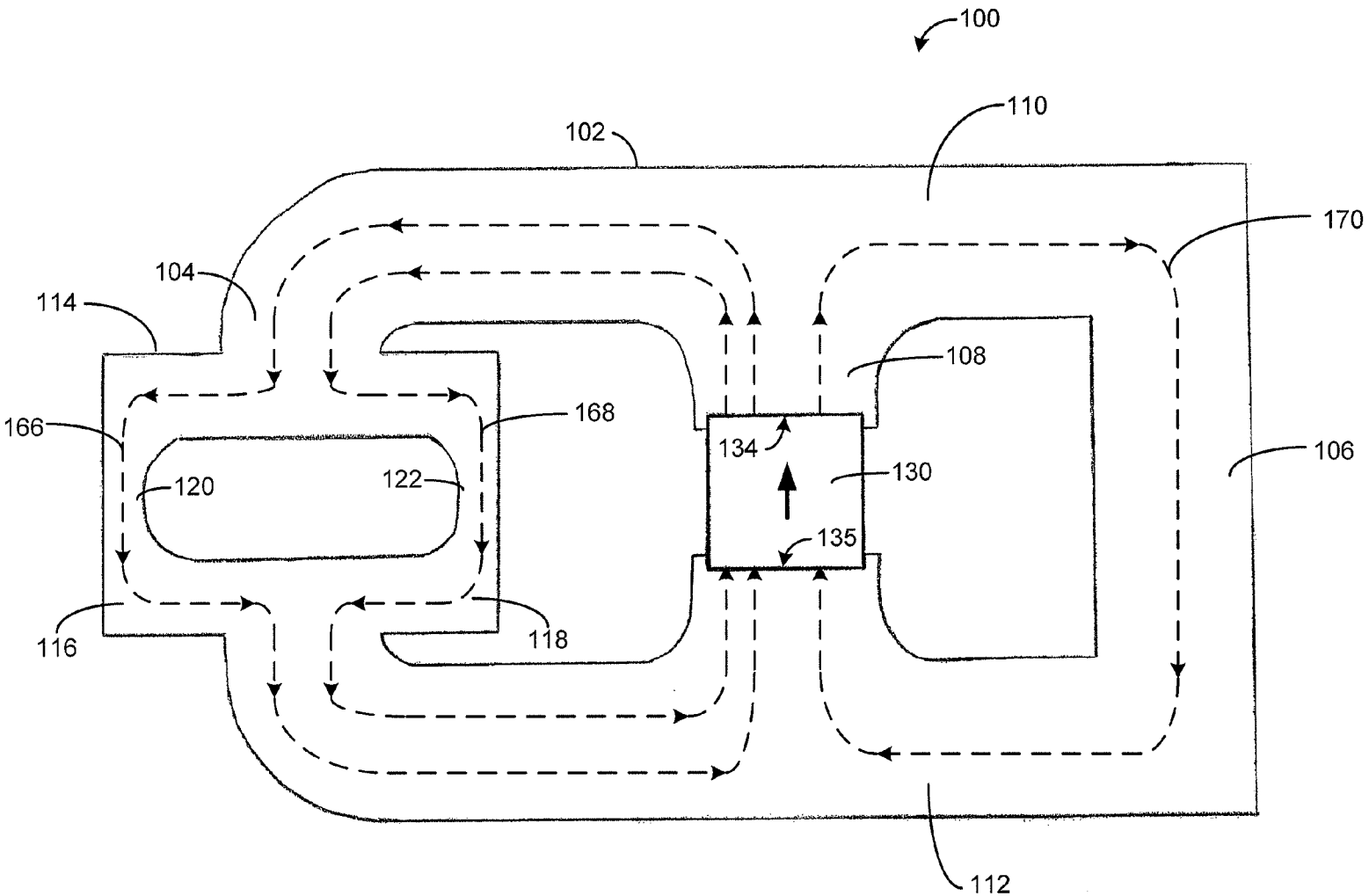
FIG. 10 depicts magnetic flux paths within the magnetic power converter of FIG. 8 when the magnet is present and no current flows through the input coils.

FIG. 10 illustrates magnetic flux produced by the permanent magnet 130 when no input power is applied to the core 102. The permanent magnet 130 is positioned within the middle leg 108 of the core 102 and the magnet 130 comprises a neodymium iron boron magnet having a magnetic energy product of 52 MGOe. No input signal is provided by the power source 149. As shown by FIG. 10, the permanent magnet 130 produces magnetic flux which travels through the core 102 along a plurality of magnetic flux paths 166, 168, and 170. The magnetic flux of the magnetic flux path 166 travels from the north pole 134 of the magnet 130, up the middle leg 108, along the upper transverse piece 110 to the left leg 104, down the left leg 104 through the left portion 116 of the toroid 114, along the lower transverse piece 112, and up the middle leg 108 to the south pole 135. The magnetic flux of the magnetic flux path 168 travels up from the north pole 134 of the magnet 130 along the middle leg 108 to the upper transverse piece 110, across the upper transverse piece 110 to the left leg 104, down the left leg 104 through the right portion 118 of the toroid 114 to the lower transverse piece 112, and through the lower transverse piece 112 to the south pole 135 of the magnet 130 via the middle leg 108. The magnetic flux of the magnetic flux path 170 travels away from the north pole 134 of the magnet 130, up the middle leg 108 to the upper transverse piece 110, along the upper transverse piece 110 to the right leg 106, down the right leg 106 and along the lower transverse piece 112 and back up the middle leg 108 to the south pole 135 of the magnet 130. Thus, when no input signal is provided by the power source 149, the magnetic flux of the magnetic flux paths 166 and 168 travels in a counter-clockwise direction and the magnetic flux of the magnetic flux path 170 travels in a clockwise direction.

In the embodiment described above, the magnetic flux density ($B_m$) in the pinch point 120 is approximately 9.8 KG, the magnetic flux density ($B_m$) in the pinch point 122 is approximately 9.8 kilogauss (KG), and the magnetic flux density ($B_m$) in the right leg 106 is approximately 7.7 KG when no input signal is provided by the power source 149. Referring to FIG. 5, when the magnetic flux density in the pinch points 120 and 122 is 9.8 KG, the respective relative permeability in each pinch point 120 and 122 is approximately 7,200, which is relatively high. Furthermore, when the magnetic flux density through the right leg 106 is 7.7 KG, the relative permeability through the right leg 106 is approximately 7,900, which is near the maximum permeability for M19 electrical steel. Accordingly, the reluctance through such magnetic flux paths 166, 168, and 170 is low when no input power is applied to the core 102.

Significantly, the core 102 is dimensioned such that the lengths of the magnetic flux paths 166, 168, and 170 are approximately equal when no electrical current flows through the input coils 140 and 142. Thus, magnetic flux traveling through the magnetic flux paths 166 and 168 travels generally the same distance as flux traveling through the magnetic flux path 170. Such dimensions form a balanced reluctance bridge which allows the input coils 140 and 142 to be immune from the effect of Lenz's Law when no input signal is provided by the power source 149.

Note however that the magnetic flux paths 166 and 168 are slightly longer than the magnetic flux path 170. The effect of the shorter path 170 is offset by the larger cross-sectional area of the flux path 170.

Figure 11:
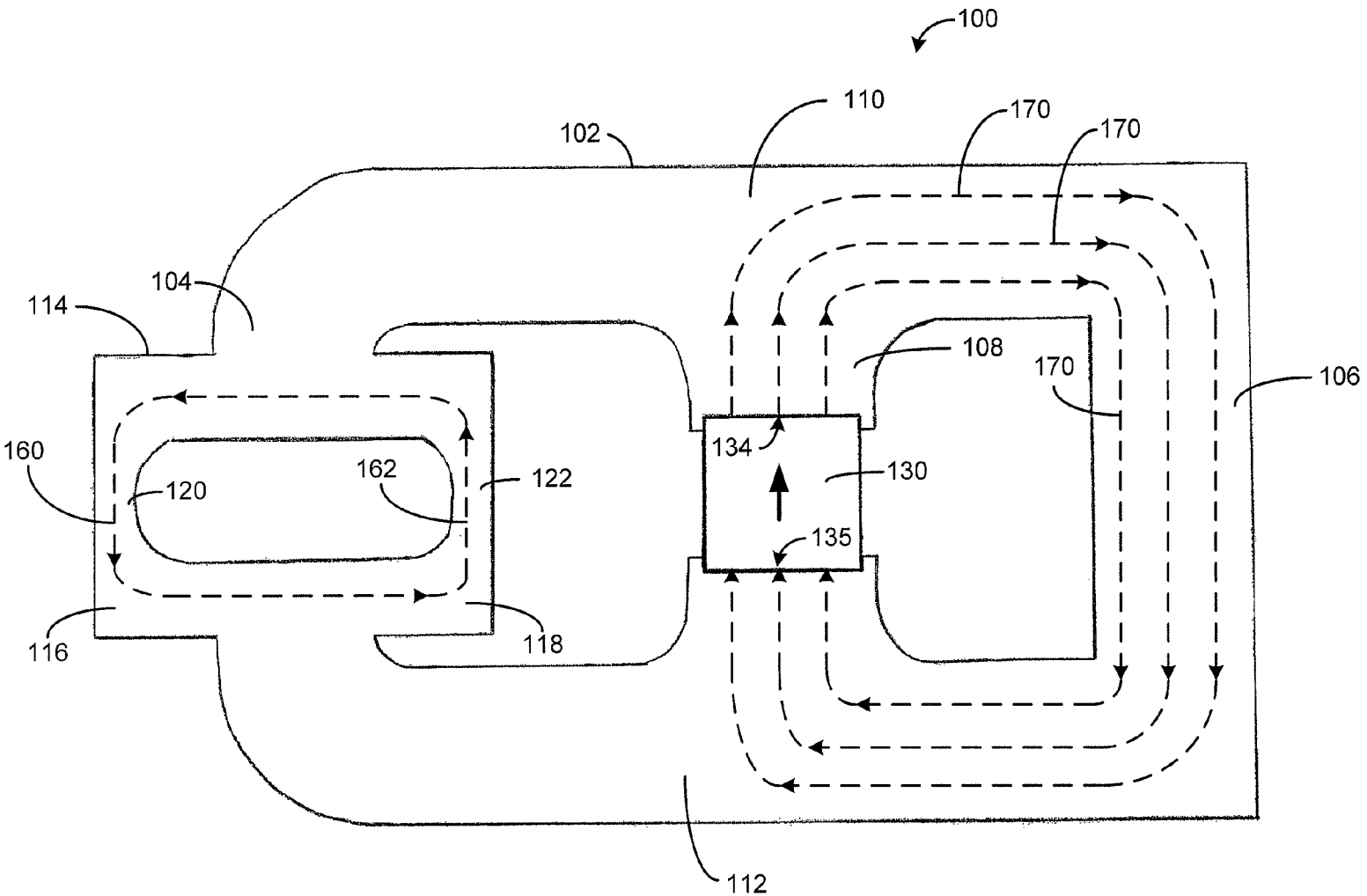
FIG. 11 depicts magnetic flux paths within the magnetic power converter of FIG. 8 when the magnet is present and current flows through the input coils.

FIG. 11 illustrates flux flowing through the core 102 when input power is applied to the core 102. The permanent magnet 130 is positioned within the middle leg 108 of the core 102 and the power source 149 (FIG. 8) provides an input signal to the input coils 140 and 142 (FIG. 8). As shown by FIG. 11, when the power source 149 provides an input signal, electrical current flows through each input coil 140 and 142 (FIG. 8) and induces the control flux 160 and 162 in the toroid 114. When the electrical current is relatively small, such as for example, 100 mA, the control flux 160 and 162 is relatively low, the magnetic flux density in the pinch points 120 and 122 is relatively low, and a small amount of PM magnetic flux is displaced from the toroid 114. However, when the electrical current is increased, the control flux 160 and 162 becomes relatively high. When the electrical current flowing through the coils 140 and 142 is increased to 980 mA, the magnetizing force ($H_{c1}$) and ($H_{c2}$) produced by each coil 140 and 142 is equal to approximately 254.54 Oe. Furthermore, the magnetic flux density ($B_{c1}$) and ($B_{c2}$) through each respective pinch point 120 is approximately 17.5 KG, while the magnetic flux density through the output ($B_{out}$) is equal to only approximately 11.7 KG. Thus, each control flux ($\phi_{c1}$) 160 and ($\Phi_{c2}$) 162 is equal to approximately 28,207.5 Mx. Referring to FIG. 5, when the magnetic flux density is equal to approximately 17.5 KG, the relative permeability of the pinch points 120 and 122 is equal to approximately 60. Such low permeability causes the reluctance to become high, creating virtual air gaps in the pinch points 120 and 122. When the magnetic flux density in the right leg 106 is equal to approximately 11.7 KG, however, the relative permeability in the right leg 106 is equal to approximately 4,800. Therefore, a significant amount of the magnetic flux produced by the permanent magnet flows through the magnetic flux path 170 rather than through the magnetic flux paths 166 and 168 since the permeability of the right leg 106 is significantly higher than the permeability of the pinch points 120 and 122 when current flows through the coils 140 and 142.

When the magnetic flux from the magnetic flux paths 166 and 168 is diverted through the magnetic flux path 170, the magnetic flux flowing through the right leg 106 increases significantly. According to Faraday's Law of induction, such a change in magnetic flux induces an electromotive force in the output coil 159, thereby converting the potential magnetic energy of the magnet 130 into kinetic electrical energy which may be used to provide electrical power to a load 70.

Furthermore, as set forth above, Lenz's Law states that the polarity of the electromotive force in the output coil 159 produces a current whose magnetizing force opposes the original change in flux. Thus, the magnitude of the opposing magnetizing force produced by the output coil 159 is equal to the magnitude of the total magnetizing force ($H_{TOTAL}$) produced by the input coils 140 and 142 and the magnet 130. The total magnetizing force ($H_{TOTAL}$) is set forth in the equation $$H_{TOTAL}=H_m+H_{c1}+H_{c2}$$

where $H_m$ is the magnetizing force produced by the magnet 130, $H_{c1}$ is the magnetizing force produced by the input coil 140, and $H_{c2}$ is the magnetizing force produced by the input coil 142. As set forth above, the magnetizing force ($H_{c1}$) produced by the input coil 140 and the magnetizing force ($H_{c2}$) produced by the input coil 142 are equal in magnitude. However, it is significant to note that the input coils 140 and 142 are opposite in polarity with respect to the output coil 159. Thus, $$H_{TOTAL}=H_m+H_{c1}-H_{c2}.$$

Since $H_{c1}$ and $H_{c2}$ are equal in magnitude, they cancel one another out with respect to the output coil 159 such that $$H_{TOTAL}=H_m.$$

Accordingly, the opposing magnetizing force produced by the current in the output coil 159 only opposes the magnetizing force ($H_m$) of the magnet 130, thereby effectively isolating the input coils 140 and 142 from the output coil 159 and immunizing the input coils 140 and 142 from the effect of Lenz's Law. However, due to the fact that the input coils 140 and 142 are indirectly controlling the permanent magnet 130, the magnetizing force produced by the current in the output coil 159 only opposes the flux from the magnet 130 even if the input coils 140 and 142 are not in opposition. Thus, the opposing polarities of the input coils 140 and 142 are used to clearly demonstrate the isolation of the input coils 140 and 142 from the output coil 159.

The total input power is defined by the equation $$P_{in}=I_{in}^2R_{in}$$

where $I_{in}$ is the input current and $R_{in}$ is the total input resistance. Thus, when the input current ($I_{in}$) is equal to 980 mA, the total input power ($P_{in}$) of the magnetic power converter 100 is set forth in the equation $$P_{in}=(0.980\text{ A})^2\times(1.52\Omega)$$

which equals approximately 1.46 W. As set forth above, frequency is a component of the standard equation for the transformer but is not a component of the standard equation for magnetizing force. Thus, by increasing the frequency of the current flowing through the input coils 140 and 142, the electromotive force in the output coil 159 is increased, but the magnetizing force produced by the output coil 159 remains the same.

Figure 12:
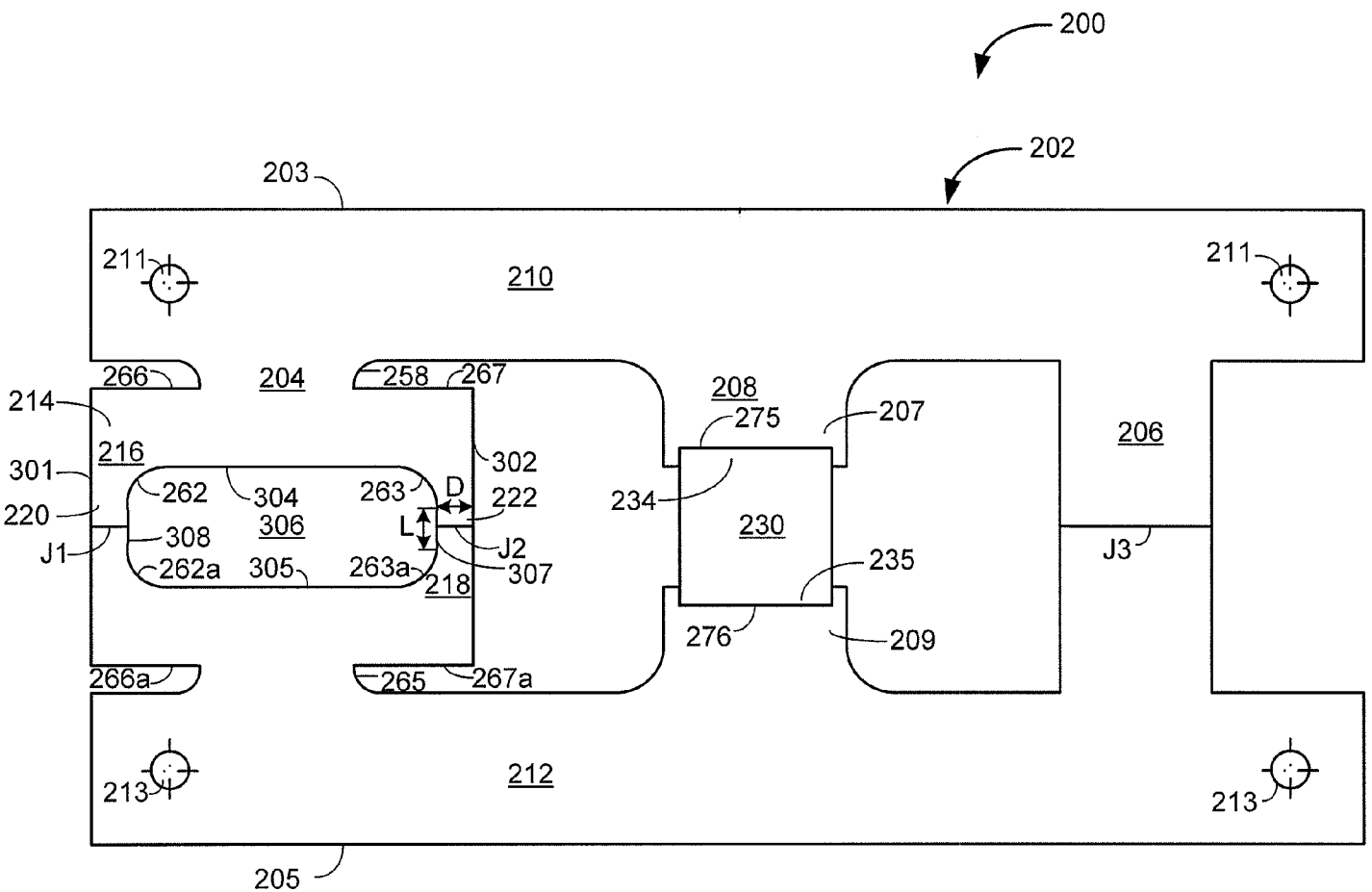
FIG. 12 is a top plan view of a magnetic power converter according to an exemplary embodiment of the disclosure.

FIG. 12 is a top plan view of a magnetic power converter 200 according to another exemplary embodiment of the present disclosure. This embodiment has flux patterns substantially similar to the embodiment of FIGS. 8-11 discussed above, and has a slightly different physical topology. The magnetic power converter 200 comprises a generally figure-8 shaped core 202 comprising a left leg 204, a right leg 206, a middle leg 208, an upper transverse piece 210, and a lower transverse piece 212. The left leg 204, the right leg 206, and the middle leg 208 each extend generally perpendicularly from the upper transverse piece 210 to the lower transverse piece 212.

In one embodiment, the core 202 comprises uniformly one-inch thick stack of 29 gauge M19 electrical steel laminations. Other isotropic materials, such as M14 electrical steel, with varying depths may be utilized in the core 202 in other embodiments. The M19 electrical steel comprising the core 202 is comprised of multiple layers of 29G (0.014 inch thick) steel welded together in this embodiment.

The left leg 204 comprises a toroid 214 having a left portion 216 and a right portion 218. The left portion 216 and the right portion 218 comprise pinch points 220 and 222, respectively, wherein the toroid 214 becomes narrower. In one embodiment, a ratio of the length (L) of each pinch point 220 and 222 to the corresponding depth (D) of each pinch point 220 and 222 along that length is 0.8:1. For example, in one embodiment, the length (L) of the pinch point 220 is 0.2 inches and the depth (D) of the pinch point 220 is 0.25 inches. However, other pinch point 220 and 222 ratios involving other lengths and depths are possible in other embodiments.

The left leg 204 comprises a neck 258 disposed above the toroid 214 between the toroid 214 and the upper transverse piece 210. The left leg 204 further comprises a neck 265 disposed below the toroid 214 between the toroid 214 and the lower transverse piece 212. The neck has a width of approximately 1 inch in this embodiment.

The toroid 214 further comprises a left upper toroid surface 266 on the left portion 216 and a right upper toroid surface 267 on the right portion 218. The left upper toroid surface 266 and the right upper toroid surface 267 are disposed beneath the neck 258. The toroid 214 further comprises a left lower toroid surface **266*a* on the left portion 216 and a right lower toroid surface 267*a* on the right portion 218. The left lower toroid surface 266*a* and the right lower toroid surface 267*a* are disposed above the neck 265**.

The left portion 216 of the toroid 214 is bounded by a left side surface 301, which is generally flat. The right portion 218 of the toroid 214 is bounded by a right side surface 302, which is generally flat.

The toroid 214 further comprises a central opening 306, which is generally oblong and is bounded by a curved surface 262, a curved surface 263, a curved surface **262*a*, a curved surface 263*a*, an upper flat surface 304, a lower flat surface 305, a right vertical surface 307, and a left vertical surface 308. The right and left vertical surfaces 307 and 308 define the length (L) of the pinch point 222 and 220**, respectively.

The middle leg 208 comprises a permanent magnet 230 positioned within the middle leg 208 such that the north pole 234 of the magnet 230 is oriented towards the upper transverse piece 210 and the south pole 235 of the magnet is oriented towards the lower transverse piece 212. The permanent magnet 230 provides a constant magnetic flux throughout the core 202. In one embodiment, the permanent magnet 230 comprises a one inch cube of neodymium-iron-boron magnet having a magnetic energy product of fifty-two (52) MGOe, although other types of permanent magnets 230 having varying magnetic energy products are possible in other embodiments.

The right leg 206 has a substantially uniform width between the upper transverse piece 210 and the lower transverse piece 212. In one embodiment, the right leg 206 is one inch wide, but other widths are possible in other embodiments.

Like the embodiment shown in FIG. 8, the magnetic power converter 200 further comprises an input coil (not shown) positioned around the pinch point 220 and an input coil (not shown) positioned around the pinch point 222. Each input coil is wound around a bobbin (not shown) comprising insulative material, such as, for example, polyoxymethylene plastic (Delrin®), and the input coils are in series with one another. The bobbins (not shown) are positioned such that the coils are surround the corresponding pinch points 220 and 222. The polarity of the input coils in this embodiment is substantially similar to that of the input coils 120 and 122 of FIG. 8.

Like the embodiment shown in FIG. 8, the magnetic power converter 100 further comprises an output coil (not shown) positioned around the right leg 206. When a change in magnetic flux traveling through right leg 206 occurs, an electromotive force is induced in the output coil causing the output coil to generate electrical power to a load (not shown).

In the illustrated embodiment, the core 202 is formed from two portions, an upper portion 203 and a lower portion 205, which portions 203 and 205 are joined at a joint J1 on the left portion 216 of the toroid 214, at a joint J2 on the right portion 218 of the toroid 214, and at a joint J3 on the right leg 206. The upper portion 203 is joined to the lower portion 205 via clamps (not shown) built into the bobbins (not shown) on the left leg 204 and the right leg 206, as further discussed herein.

The magnet 230 extends between a surface 275 of an extension 207 of the upper portion 203 and a surface 276 of an extension 209 on the lower portion 205. The extension 207, the magnet 230, and the extension 209 form the middle leg 208. The magnet 230 is held in place by the clamps (not shown) on the left leg 204 and the right leg 206.

The upper portion 203 comprises a plurality of tooling holes 211 that extend through the core 202 and are used in assembling the upper portion 203 to the lower portion 205. In the illustrated embodiment, the upper portion 203 comprises two (2) tooling holes 211, though other embodiments may employ more or fewer tooling holes 211. The tooling holes 211 in the illustrated embodiment comprise 0.255 diameter circular holes.

The lower portion 205 also comprises a plurality of tooling holes 213 that extend through the core 202 and are used in assembling the upper portion 203 to the lower portion 205. In the illustrated embodiment, the lower portion 205 comprises two (2) tooling holes 213, though other embodiments may employ more or fewer tooling holes 213. The tooling holes 213 in the illustrated embodiment comprise 0.255 diameter circular holes.

Figure 13:
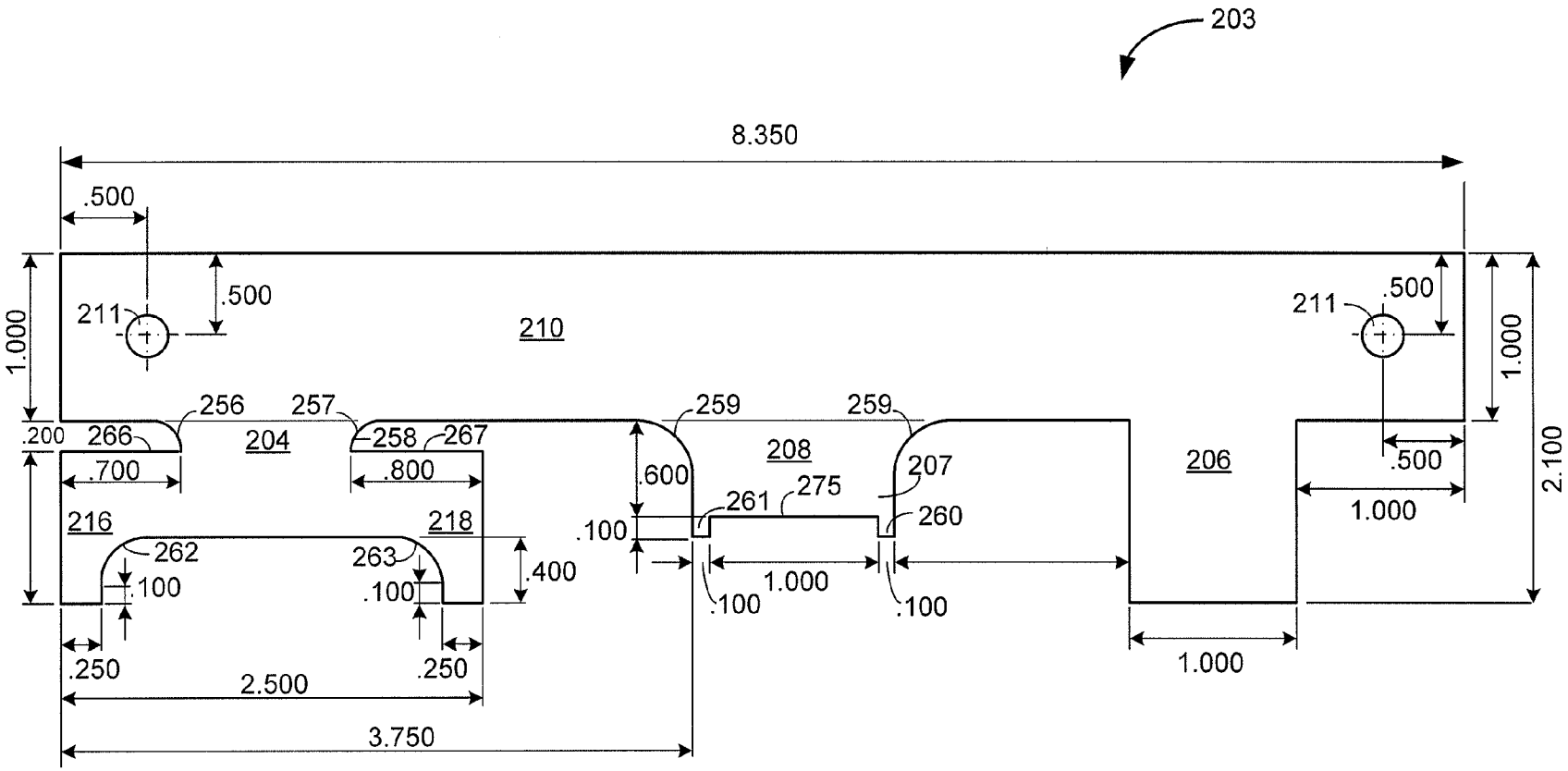
FIG. 13 is a top plan view of the top portion of the core of the magnetic power converter of FIG. 12.

FIG. 13 is a dimensioned top plan view of the top portion 203 of the core 202 (FIG. 12) according to an exemplary embodiment of the disclosure. Note that the bottom portion 205 is substantially similar to and a mirror image of the top portion 203 in this embodiment.

The neck 258 is bounded by curved surfaces 256 and 257. The curved surfaces 256 and 257 each comprise a 0.2 inch radius in this embodiment. The left portion 216 and the right portion 218 of the toroid 214 (FIG. 12) are somewhat mirror imaged to one another. However, the left upper toroid surface 266 of the left portion 216 is slightly shorter than the right upper toroid surface 267 of the right portion 218. In the illustrated embodiment, the upper toroid surface 266 of the left portion 216 is 0.700 wide and the upper toroid surface 267 of the right portion 218 is 0.800 wide. This difference in lengths is important because when flux (not shown) travels from the magnet 230 (FIG. 12) through the left portion 216 and the right portion 218, the flux needs to distribute equally between the left portion 216 and the right portion 218. The flux path through the right portion 218 requires a sharper turn than the path through the left portion 216, such that if the right portion 218 was identical to the left portion 216, the left portion 216 would receive more flux than the right portion 218. Shortening the upper toroid surface 266 offsets this difference and enables substantially identical flux flow through the left portion 216 and the right portion 218.

The left portion 216 of the toroid 214 comprises a curved surface 262 with a 0.3 inch radius in this embodiment. The right portion 218 of the toroid 214 comprises a curved surface 263 with a 0.3 inch radius in this embodiment.

The extension 207 from the upper portion 203 comprises curved surfaces 259 which have a 0.4 in radius in this embodiment. Lips 260 and 261 extend from the extension 207 and bound right and left sides of the magnet 230 (FIG. 12). The surface 275 bounds the north pole side of the magnet 230.

Figure 14:
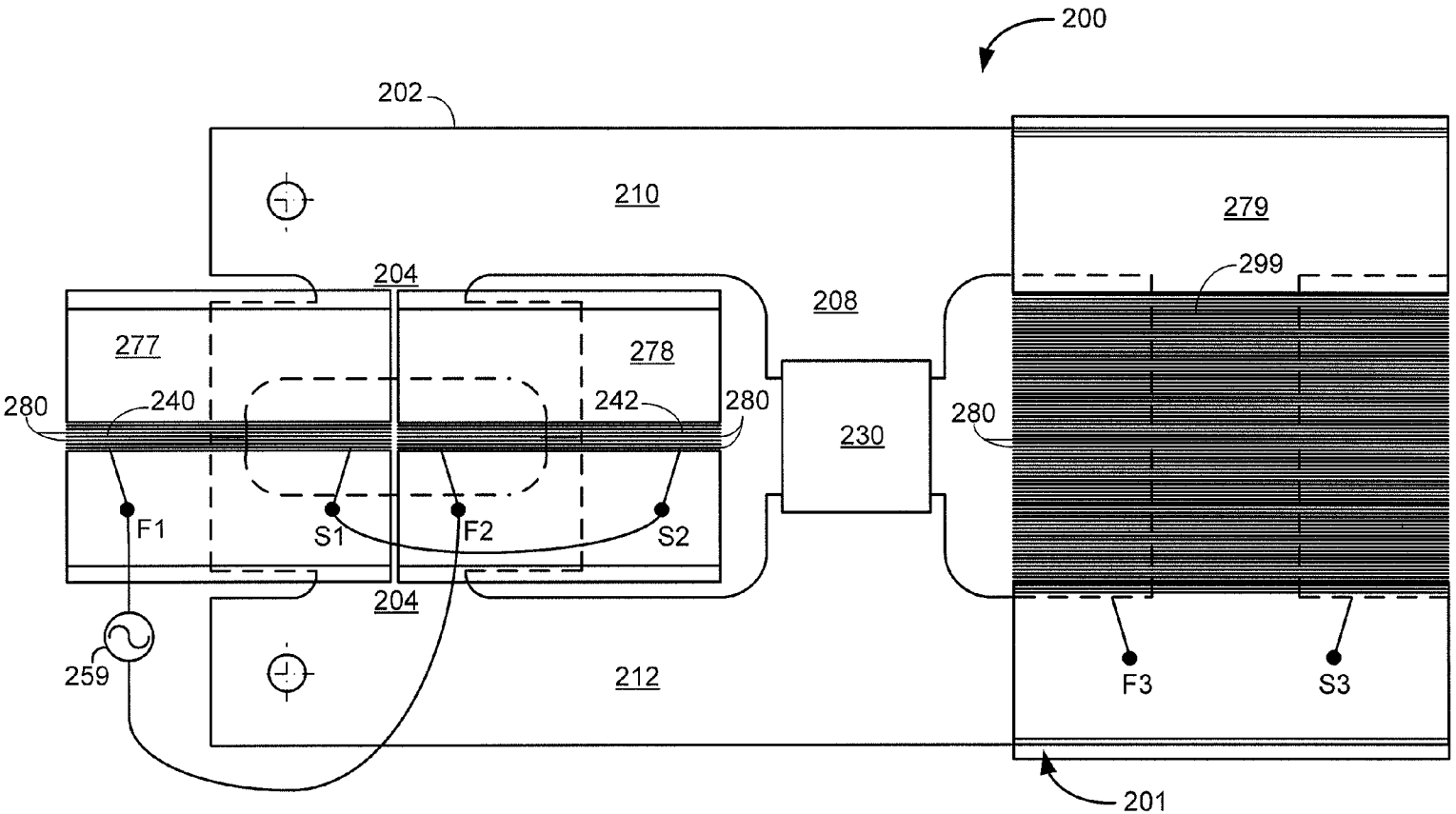
FIG. 14 is a top plan view of the magnetic power converter of FIG. 12, with input and output coils installed.

FIG. 14 is a top plan view of the magnetic power converter 200 of FIG. 12, with a bobbin 277 installed on the left portion 216 of the toroid 214, a bobbin 278 installed on the right portion 218 of the toroid 214, and a right leg bobbin 279 installed on the right leg 206.

The bobbins 277 and 278 each comprise a plurality of insulated multifurcate wires 280. In one embodiment, each of the wires 280 comprises twenty-two strands of number thirty-six (36) copper wire. However, other types of wiring involving different numbers of strands are possible in other embodiments. The wires 280 on the bobbin 277 comprise a left input coil 240 on the left portion 216 (FIG. 12) of the toroid 214 (FIG. 12). The left input coil 240 initiates at a lead point F1 and terminates at a lead point S1. The wires 280 on the bobbin 278 comprise a right input coil 242 on the right portion 218 (FIG. 12) of the toroid 214 (FIG. 12). The right input coil 242 initiates at a lead point F2 and terminates at a lead point S2. During operation of the magnetic power converter 200, the lead point S1 is connected directly to the lead point S2, such that the input coils 240 and 242 are in series.

In one embodiment, each of the coils 240 and 242 has 205 turns and a resistance of 0.76 Ohms (Ω), although different resistances and numbers of turns may be utilized in other embodiments.

The input coils 240 and 242 are connected in series to the AC power source 259. The power source 259 is configured to provide electrical current to the input coils 240 and 242. In one embodiment, the power source 259 provides a bipolar sine wave input signal.

The right leg bobbin 279 comprises a plurality of insulated multifurcate wires 280 that make up the output coil 299. In one embodiment, the output coil comprises insulated multifurcate wiring comprising a dual coil having sixteen strands of number thirty-two (32) copper wire and six hundred (600) turns. Different types of coils having more or fewer turns are possible in other embodiments.

The output coil 299 initiates at a lead point F3 and terminates at a lead point S3. The output coil is connected to a load (not shown).

Figure 15A:
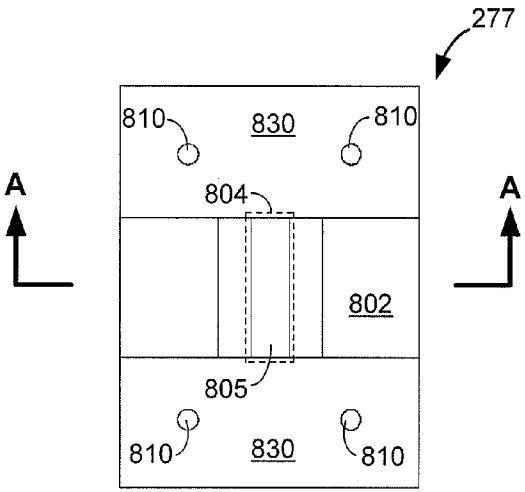
FIG. 15*a* is a top plan view of a bobbin according to an exemplary embodiment of the disclosure.

FIG. 15*a* is a top plan view of the bobbin 277 of FIG. 15*a*. Note that the bobbin 278 of FIG. 14 is substantially similar to the bobbin 277. An opening 805 extends through the bobbin 277 and is received by the pinch points 220 and 222 (FIG. 12) when the bobbin 277 is installed on the core 202 (FIG. 12). The opening 805 is centrally located in the bobbin 277 and is generally rectangular in shape.

The bobbin 277 further comprises a winding surface 804 that is similar in shape to the opening 805 and spaced apart from the opening 805. The wires 280 (FIG. 14) are wound around the winding surface 804, which is generally rectangular. The dimensions of the winding surface are necessarily larger than the opening 805.

Figure 15B:
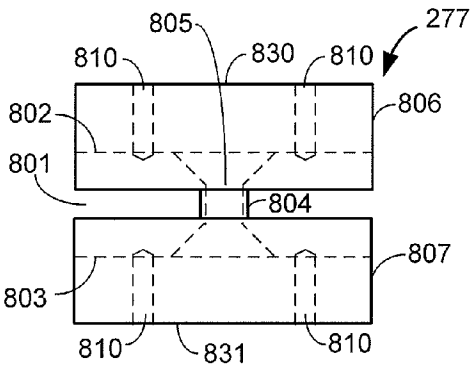
FIG. 15*b* is a front plan view of the bobbin of FIG. 15*a*.

FIG. 15*b* is a front plan view of the bobbin 277 of FIG. 15*a*. The bobbin 277 comprises an upper portion 806 and a lower portion 807 with an aperture 801 disposed between the upper portion 806 and the lower portion 807. The winding surface 804 is disposed within the aperture and extends between the upper portion 806 and lower portion 807.

The opening 805 extends generally vertically through the bobbin 277 and is received by the pinch points 220 and 222 (FIG. 12) when the bobbin 277 is installed on the core 202 (FIG. 12). In this regard, the opening 804 is generally rectangular in cross section, and is sized slightly larger than the pinch points 220 and 222.

The upper portion 806 and the lower portion 807 of the bobbin 277 each comprise a plurality of openings 810 for receiving fasteners (not shown) for attaching the bobbin 277 to the core 202 (FIG. 12). In this regard, the bobbin 277 acts as a clamp to join the upper portion 203 of the core 202 to the lower portion 205 of the core 202, as further discussed herein.

Figure 15C:
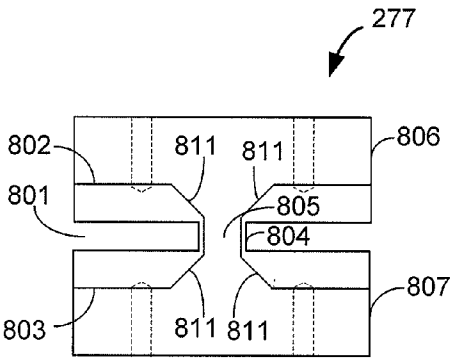
FIG. 15*c* is a cross sectional view of the bobbin of FIG. 15*a*, taken along section lines A-A of FIG. 15*a*.

FIG. 15*c* is a cross-sectional view of the bobbin 277 of FIG. 15*a*, taken along section lines A-A. Surface 802 defines a channel 808 (FIG. 15*d*) that extends generally horizontally through the top portion 806 of the bobbin 277. Surface 803 defines a channel 809 (FIG. 15*d*) that extends generally horizontally through the bottom portion 807 of the bobbin 277. Tapered walls 811 extend from the surfaces 802 and 803 to the opening 805 as shown. The tapered walls 811 help to guide the upper portion 203 (FIG. 12) and lower portion 205 (FIG. 12) of the core 202 (FIG. 12) into place within the opening 805 when the bobbin 277 is being installed on the core 202.

Figure 15D:
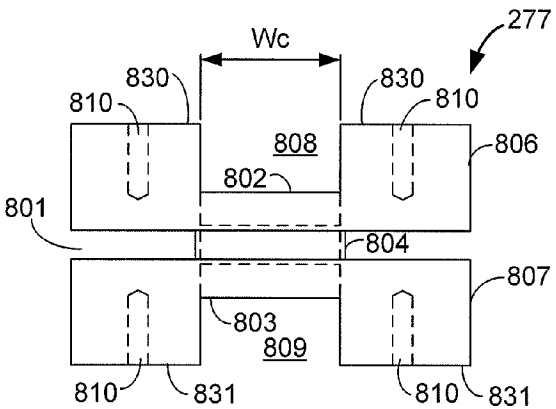
FIG. 15*d* is a right side plan view of the bobbin of FIG. 15*a*.

FIG. 15*d* is a side plan view of the bobbin 277 of FIG. 15*a*. The channel 808 is recessed into the top portion 806 of the bobbin 277. Similarly, the channel 809 is recessed into the bottom portion 807 of the bobbin 277. The width We of the channels 808 and 809 is necessarily slightly larger than the thickness of the core 202 (FIG. 12), as the core 202 is disposed within the channels 808 and 809 when the bobbin 277 is installed on the core 202.

Figure 16B:
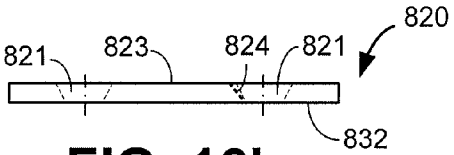
FIG. 16*b* is a front plan view of the clamp plate of FIG. 16*a*.
Figure 16A:
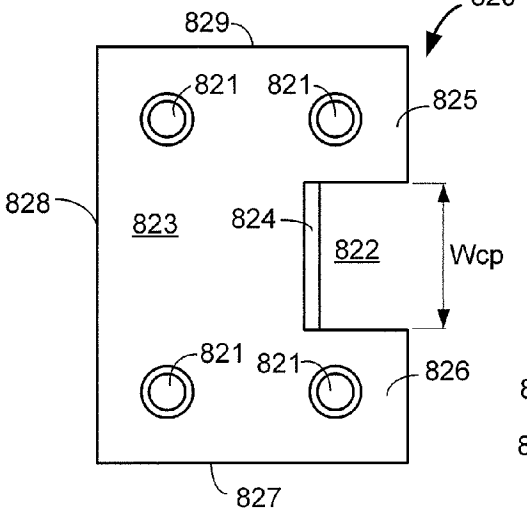
FIG. 16*a* is a top plan view of a clamp plate according to an exemplary embodiment of the present disclosure.

FIG. 16*a* is a top plan view of a clamp plate 820 according to an embodiment of the present disclosure. Two clamp plates 820 are used to couple the bobbin 277 (FIG. 14) to the core 202 (FIG. 14), as further discussed herein. Similarly, two clamp plates 820 are used to couple the bobbin 278 (FIG. 14) to the core 202 (FIG. 14).

Each clamp plate 820 comprises a unitary, generally rectangular plate with a generally smooth and generally flat top surface 823 and a generally smooth and generally flat bottom surface 832 (FIG. 16*b*). The clamp plate 820 further comprises a plurality of openings 821 extending through the plate for receiving fasteners (not shown) that couple the clamp plate 820 with the bobbin 277. In the illustrated embodiment, the openings 821 are standard countersunk holes for receiving standard, recessed-head threaded fasteners. The openings 821 are aligned with the openings 810 (FIG. 15*a*) in the bobbin 277 (FIG. 15*a*). The illustrated embodiment comprises (4) openings 821 and 810, though more or fewer openings may be employed in other embodiments.

The clamp plate 820 further comprises a recessed area 822 flanked by two protrusions 825 and 826 on one side of the plate 820. The recessed area 822 receives the core 202 (FIG. 14) when the clamp plate 820 is installed on the magnetic power converter 200. The recessed area 822 has a width Wcp that is thus necessarily slightly larger than the thickness of the core 202. An angled surface 824 extends upwardly from the bottom surface 832 (FIG. 16*b*) of the clamp plate 820 to the top surface 823 within the recessed area 822, as shown. A top edge and a bottom edge 829 and 827, respectively, of the clamp plate 820 are generally straight and generally parallel to one another. A left edge 828 of the clamp plate 820 is generally straight and generally perpendicular to the top edge and bottom edge 829 and 827.

FIG. 16*b* is a front side plan view of the clamp plate 820 of FIG. 16*a*. The plate 820 is generally thin and flat, as shown.

Figure 16C:
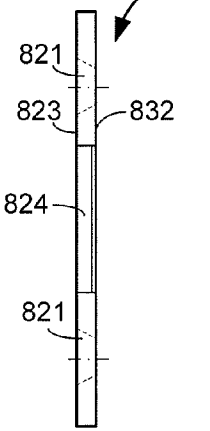
FIG. 16*c* is a right side plan view of the clamp plate of FIG. 16*a*.

FIG. 16C is a right side plan view of the clamp plate 820 of FIG. 16*a*. When the clamp 820 is installed, the bottom surface 832 contacts the top surface 830 of both the bobbin 277 and the left upper toroid surface 266 (FIG. 12), as illustrated in FIG. 17.

Figure 17:
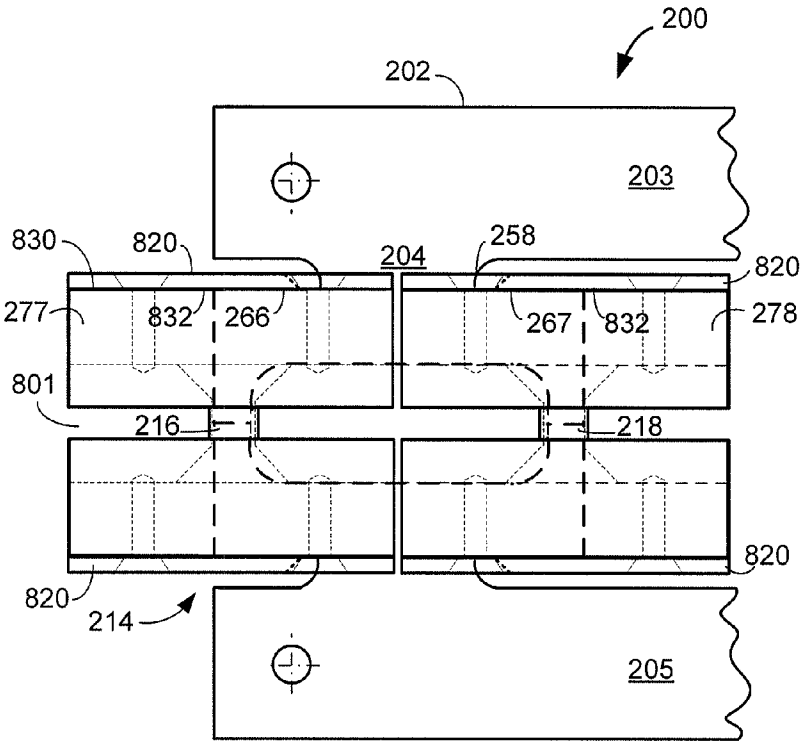
FIG. 17 illustrates the installation of bobbins on the pinch points of the core.

FIG. 17 is a partial view of the magnetic power converter 200 of FIG. 14 illustrating the installation of the clamp plates 820 and the bobbins 277 and 278 onto the core 202. The upper portion 203 of the core 202 is joined to the lower portion 205 of the core 202 as discussed herein, and secured together by the bobbins 277, 278 and the clamp plates 280. In order to assembly the magnetic power converter 200 in this fashion, the upper portion 203 and the lower portion 205 are installed into the bobbins 277 and 278 such that the pinch points 220 (FIG. 12) and 222 (FIG. 12) of the core 202 are received by the openings 805 in the bobbins 277 and 278, respectively. The core 202 is received by the channels 808 and 809 (FIG. 15*a*) in the bobbins 277 and 278.

The clamp plates 820 are then installed by sliding the clamp plates 820 onto the left portion 216 and right portion 218 of the toroid 214 such that the bottom surfaces 832 of the clamp plates 820 rest against the toroid surfaces 266, 266*a*, 267, and 267*a* of the bobbins 277 and 278. The fasteners (not shown) are then installed through the openings 821 of the clamp plates 820 and through the openings 810 on the bobbins 277 and 278 to secure the clamp plates 820 to the bobbins 277 and 278. When the clamp plates 820 are rigidly affixed to the bobbins 277 and 278, the bottom surfaces 832 of the clamp plates 820 press against the toroid surfaces 266, 266*a*, 267, and 267*a* of the bobbins 277 and 278 to rigidly hold the upper portion 203 and lower portion 205 of the core together.

Figure 18C:
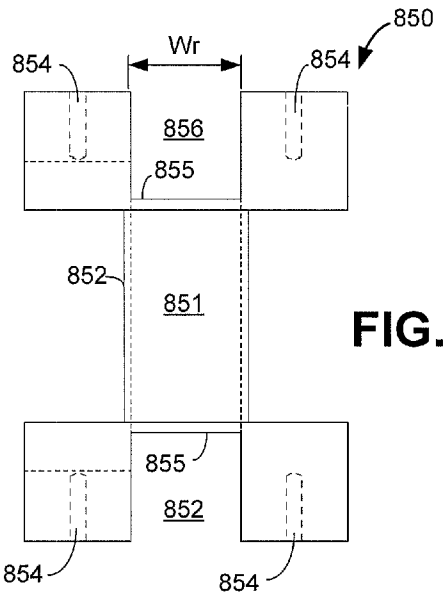
FIG. 18*c* is a right side plan view of the bobbin of FIG. 18*a*.
Figure 18A:
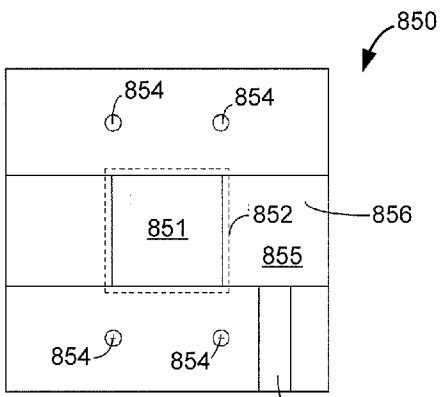
FIG. 18*a* is a top plan view of a right leg bobbin according to an exemplary embodiment of the disclosure.

FIG. 18*a* is a top plan view of the right leg bobbin 279 according to an exemplary embodiment of the present disclosure. The right leg bobbin 279 comprises a central opening 851 that extends through the bobbin 279. The opening 851 is generally rectangular in cross section and receives the right leg 206 (FIG. 12) when the upper portion 203 (FIG. 12) and lower portion 205 (FIG. 12) of the core 202 (FIG. 12) are joined together at joint J3 (FIG. 12). The opening 851 is thus necessarily slightly larger than the right leg 206.

A plurality of openings 854 receive fasteners (not shown) for coupling a right leg clamp plate 750 (FIG. 19) to the right leg bobbin 850. A channel 856 is recessed into the right leg bobbin 850 for receiving the core 202 when the right leg bobbin 840 is installed, as further discussed herein.

Figure 18B:
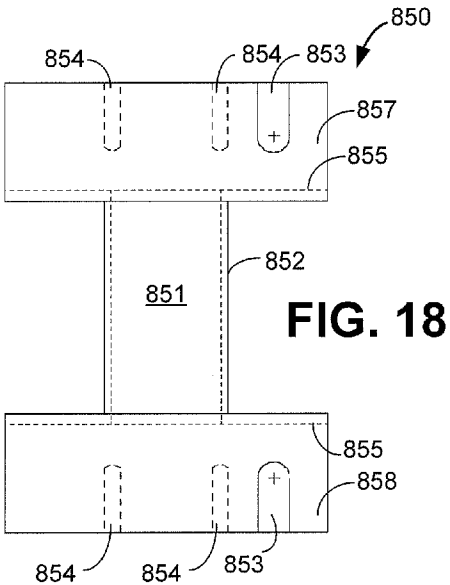
FIG. 18*b* is a front plan view of the bobbin of FIG. 18*a*.

FIG. 18*b* is a front plan view of the right leg bobbin 850 of FIG. 18*a*. A winding surface 852 is disposed in the center of the bobbin 850, and the winding surface extends between a top portion 857 and a bottom portion 858. The winding surface 850 is generally rectangular in cross section, and the wires 280 (FIG. 14) are wound against the winding surface 850.

FIG. 18*c* is a right side plan view of the right leg bobbin 850 of FIG. 18*a*. The channel 856 extends across the top portion 857 and bottom portion 858 and receives the core 202 when the magnetic power converter 200 (FIG. 14) is assembled.

Figure 19:
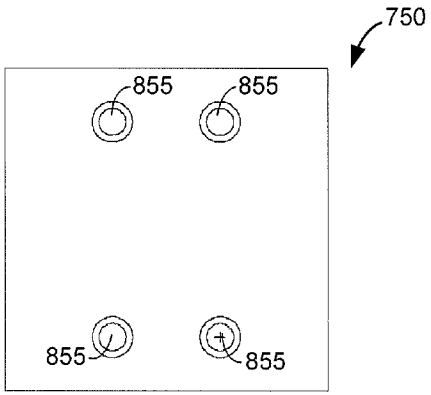
FIG. 19 is a top plan view of a right leg clamp plate according to an exemplary embodiment of the disclosure.

FIG. 19 is a top plan view of a right leg clamp plate 750 that joins the right leg bobbin 850 to the core 202 (FIG. 14). The right leg clamp plate 750 comprises a plurality of openings 855 which receive fasteners (not shown) for coupling the right leg clamp plate 750 (FIG. 19) to the right leg bobbin 850.

The right leg bobbin 850 and right leg clamp plates 750 are installed in a manner similar to the manner of installing the bobbins 277 and 278 to the core 202. The right leg clamp plates 750, when installed, apply pressure to the top portion 203 and the bottom portion 205 of the core 202 to aid in rigidly coupling the top portion 203 to the bottom portion 205.

Figure 20:
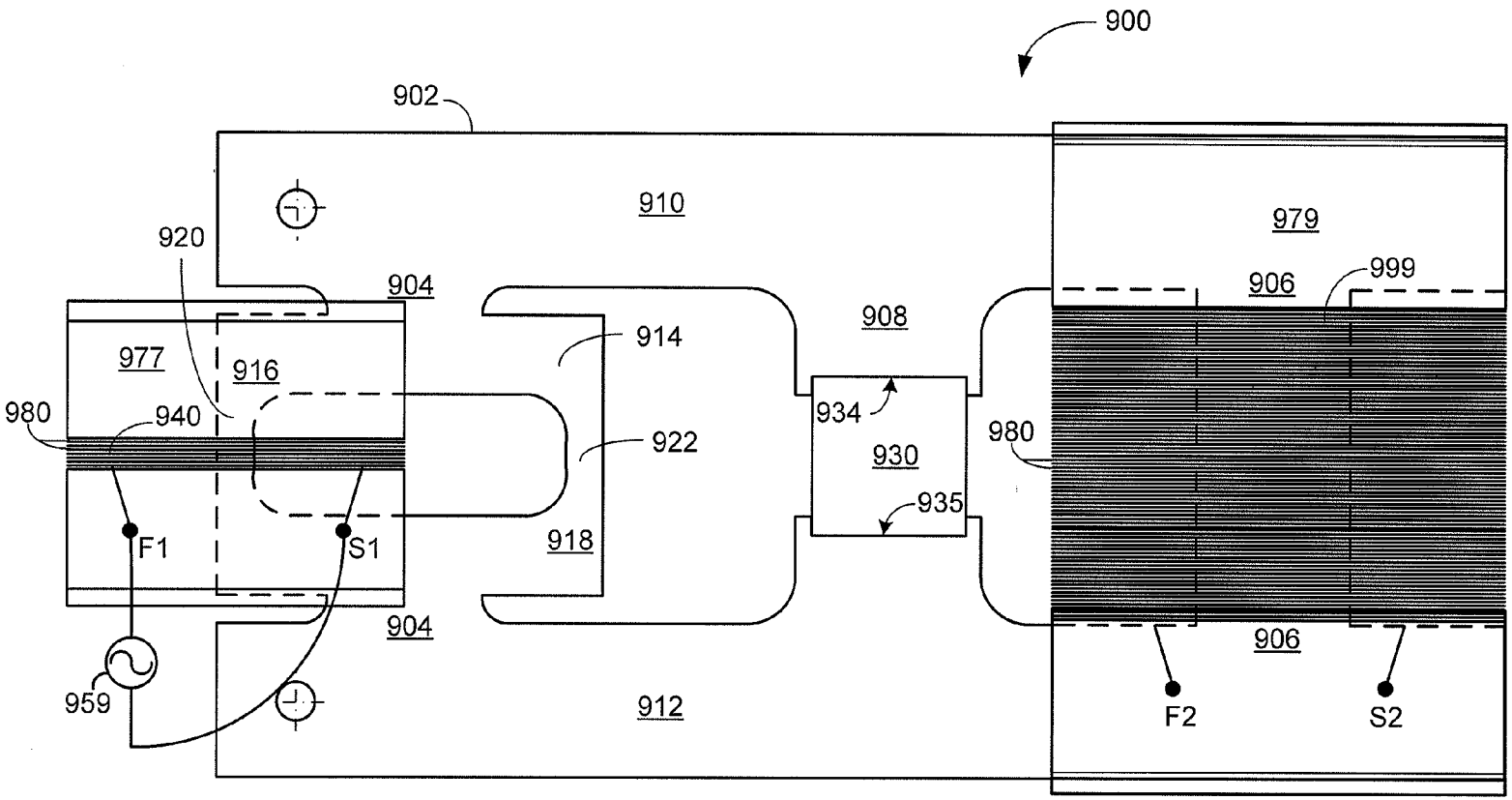
FIG. 20 is a top plan view of a magnetic power converter according to another exemplary embodiment of the disclosure.

FIG. 20 is a top plan view of a magnetic power converter 900 according to another exemplary embodiment of the present disclosure. This embodiment has a similar physical structure to the embodiment depicted by FIG. 12. The magnetic power converter 900 comprises a generally figure-8 shaped core 902 comprising a left leg 904, a right leg 906, a middle leg 908, an upper transverse piece 910, and a lower transverse piece 912. The left leg 904, the right leg 906, and the middle leg 908 each extend generally perpendicularly from the upper transverse piece 910 to the lower transverse piece 912.

In one embodiment, the core 902 comprises uniformly one-inch thick stack of 29 gauge M19 electrical steel laminations. Other isotropic materials, such as M14 electrical steel, with varying depths may be utilized in the core 902 in other embodiments. The M19 electrical steel comprising the core 902 is comprised of multiple layers of 29G (0.014 inch thick) steel welded together in this embodiment.

The left leg 904 comprises a toroid 914 having a left portion 916 and a right portion 918. The left portion 916 and the right portion 918 comprise pinch points 920 and 922, respectively, wherein the toroid 214 becomes narrower. In one embodiment, a ratio of the length (L) of each pinch point 920 and 922 to the corresponding depth (D) of each pinch point 920 and 922 along that length is 0.8:1. For example, in one embodiment, the length (L) of the pinch point 920 is 0.2 inches and the depth (D) of the pinch point 920 is 0.25 inches. However, other pinch point 920 and 922 ratios involving other lengths and depths are possible in other embodiments. The other characteristics of the toroid 914 are similar to those of the toroid 214 (FIG. 12) set forth above.

The middle leg 908 comprises a permanent magnet 930 positioned within the middle leg 908 such that the north pole 934 of the magnet 930 is oriented towards the upper transverse piece 910 and the south pole 935 of the magnet is oriented towards the lower transverse piece 912. The permanent magnet 930 provides a constant magnetic flux throughout the core 902. In one embodiment, the permanent magnet 930 comprises a one inch cube of neodymium-iron-boron magnet having a magnetic energy product of fifty-two (52) MGOe, although other types of permanent magnets 930 having varying magnetic energy products are possible in other embodiments.

The right leg 906 has a substantially uniform width between the upper transverse piece 910 and the lower transverse piece 912. In one embodiment, the right leg 906 is one inch wide, but other widths are possible in other embodiments. Note that decreasing the cross-sectional area of the right leg 906 increases the amount of power generated by the magnetic power converter 900.

The magnetic power converter 900 has a bobbin 977 installed on the left portion 916 of the toroid 914 and a right leg bobbin 979 installed on the right leg 906. The bobbin 977 comprises a plurality of insulated multifurcate wires 980. In one embodiment, each of the wires 980 comprises twenty-two strands of number thirty-six (36) copper wire. However, other types of wiring involving different numbers of strands are possible in other embodiments. The wires 980 on the bobbin 977 comprise an input coil 940 on the left portion 916 (FIG. 12) of the toroid 914 (FIG. 12). The input coil 940 initiates at a lead point F1 and terminates at a lead point S1. In one embodiment, the coil 940 has 205 turns and a resistance of 0.76 Ohms (Ω), although different resistances and numbers of turns may be utilized in other embodiments. Note that the magnetic power converter 900 only comprises one input coil 940, and the electromagnetic polarity of the coil 940 is oriented towards the upper transverse piece 910.

The input coil 940 is connected to the AC power source 959 via a tank circuit (not shown). The power source 959 is configured to provide electrical current to the input coil 940. In one embodiment, the power source 959 provides a bipolar sine wave input signal. Note that the input coil 940 should be operated at its resonance frequency. In one embodiment, the input coil 940 resonates at 500 Hz, although other frequencies are possible in other embodiments.

The right leg bobbin 979 comprises a plurality of insulated multifurcate wires 980 that make up the output coil 999. In one embodiment, the output coil 999 comprises insulated multifurcate wiring comprising a dual coil having sixteen strands of number thirty-two (32) copper wire and six hundred (600) turns. Different types of coils having more or fewer turns are possible in other embodiments.

The output coil 999 initiates at a lead point F2 and terminates at a lead point S2. The output coil 999 is connected to a load (not shown), as set forth above, via a tank circuit (not shown). The output coil 999 should also be operated at its resonance frequency.

Figure 21:
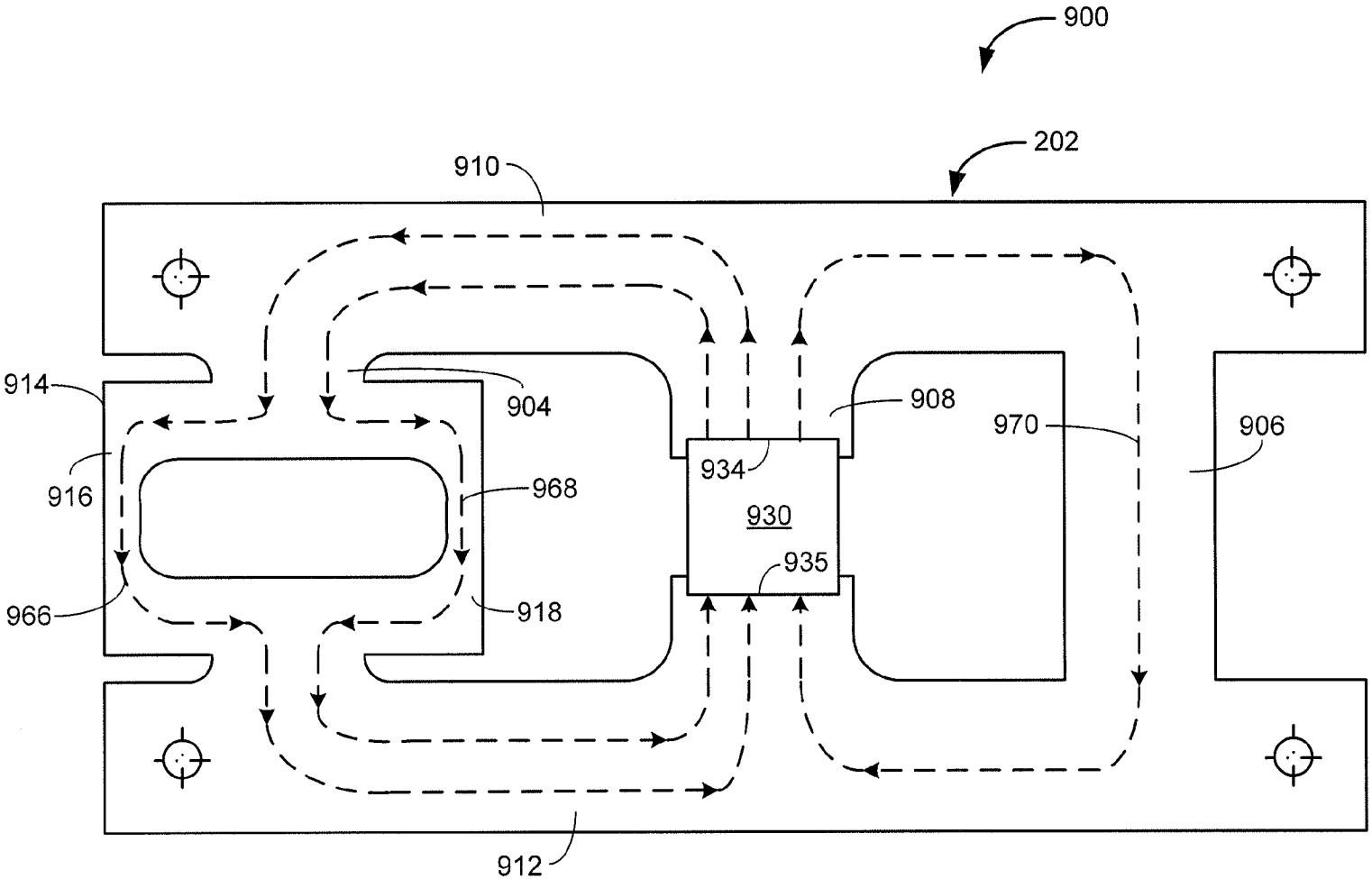
FIG. 21 depicts magnetic flux paths within the magnetic power converter of FIG. 20 when the magnet is present and no current flows through the input coil.

FIG. 21 illustrates magnetic flux produced by the permanent magnet 930 when no input power is applied to the core 902. The permanent magnet 930 is positioned within the middle leg 908 of the core 902 and the magnet 930 comprises a neodymium iron boron magnet having a magnetic energy product of 52 MGOe. No input signal is provided by the power source 959. As shown by FIG. 21, the permanent magnet 930 produces magnetic flux which travels through the core 902 along a plurality of magnetic flux paths 966, 968, and 970. The magnetic flux of the magnetic flux path 966 travels from the north pole 934 of the magnet 930, up the middle leg 908, along the upper transverse piece 910 to the left leg 904, down the left leg 904 through the left portion 916 of the toroid 914, along the lower transverse piece 912, and up the middle leg 908 to the south pole 935. The magnetic flux of the magnetic flux path 968 travels up from the north pole 934 of the magnet 930 along the middle leg 908 to the upper transverse piece 910, across the upper transverse piece 910 to the left leg 904, down the left leg 904 through the right portion 918 of the toroid 914 to the lower transverse piece 912, and through the lower transverse piece 912 to the south pole 935 of the magnet 930 via the middle leg 908. The magnetic flux of the magnetic flux path 970 travels away from the north pole 934 of the magnet 930, up the middle leg 908 to the upper transverse piece 910, along the upper transverse piece 910 to the right leg 906, down the right leg 906 and along the lower transverse piece 912 and back up the middle leg 908 to the south pole 935 of the magnet 930. Thus, when no input signal is provided by the power source 959, the magnetic flux of the magnetic flux paths 966 and 968 travels in a counter-clockwise direction and the magnetic flux of the magnetic flux path 970 travels in a clockwise direction. The reluctance through such magnetic flux paths 966, 968, and 970 is low when no input power is applied to the core 902.

Significantly, the core 902 is dimensioned such that the lengths of the magnetic flux paths 966, 968, and 970 are approximately equal when no electrical current flows through the input coil 940. Thus, magnetic flux traveling through the magnetic flux paths 966 and 968 travels generally the same distance as flux traveling through the magnetic flux path 970. Such dimensions form a balanced reluctance bridge which allows the input coil 940 to be immune from the effect of Lenz's Law when an input signal is provided by the power source 949.

Figure 22:
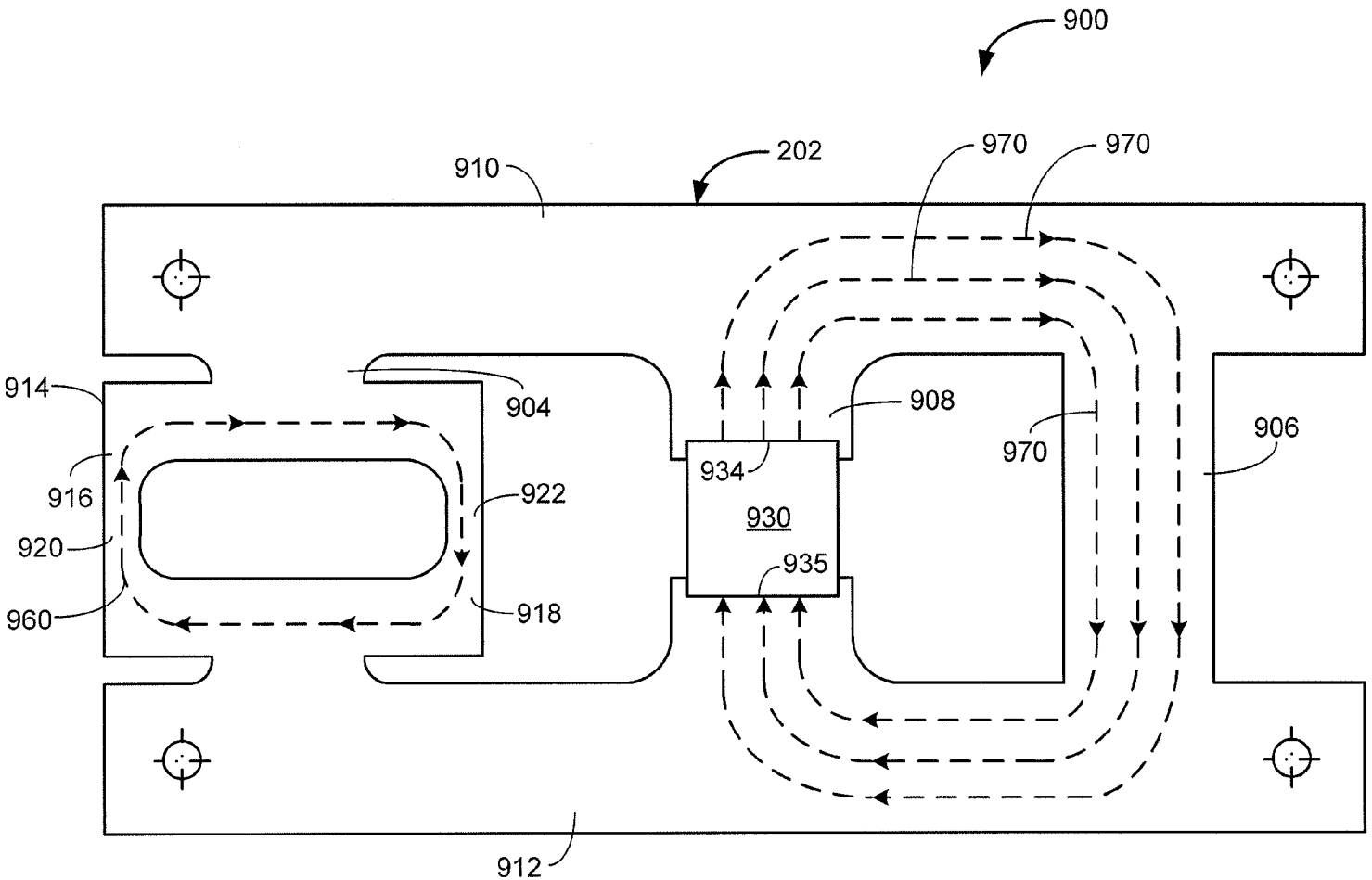
FIG. 22 depicts magnetic flux paths within the magnetic power converter of FIG. 20 when the magnet is present and current flows through the input coil.

FIG. 22 illustrates flux flowing through the core 902 of FIG. 20 when input power is applied to the core 902. The permanent magnet 930 is positioned within the middle leg 908 of the core 902 and the power source 959 (FIG. 20) provides an input signal to the input coil 940 (FIG. 20). As shown by FIG. 22, when the power source 959 provides an input signal, electrical current flows through the input coil 940 and induces the control flux 960 in the toroid 914. When the electrical current is relatively small, such as for example, 100 mA, the control flux 960 is relatively low, the magnetic flux density in the pinch points 920 and 922 is relatively low, and a small amount of PM magnetic flux is displaced from the toroid 914. However, when the electrical current is increased, the control flux 960 becomes relatively high and a majority of the control flux 960 remains captive in the toroid 914, as shown by FIG. 22. The control flux 960 remains captive in the toroid 914 due to the high reluctance created by the magnet 930 along the other flux paths 970

When the electrical current flowing through the coil 940 is increased, the magnetic flux density increases, and the relative permeability of the pinch points 920 and 922 decreases. Such low permeability causes the reluctance to become high, creating virtual air gaps in the pinch points 920 and 922. When the magnetic flux density in the right leg 906 is equal to approximately 11.7 KG, however, the relative permeability in the right leg 906 is relatively high, such as, for example, approximately 4,800. Therefore, a significant amount of the magnetic flux produced by the permanent magnet flows through the magnetic flux path 970 rather than through the magnetic flux paths 966 and 968 (FIG. 21) since the permeability of the right leg 906 is significantly higher than the permeability of the pinch points 920 and 922 when current flows through the coil 940. Note that the magnetic flux paths 966, 968 and 970 depicted by FIGS. 21 and 22 do not represent precise physical paths through the core 902 but instead represent the general paths of the magnetic flux from the permanent magnet 930. Thus, more magnetic flux is flowing through the right leg 906 of the core 902 when electrical current is flowing through the input coil 940 than when no electrical current is flowing through the input coil 940 because the magnetic flux that was flowing through the magnetic flux paths 966 and 968 is now flowing through the magnetic flux path 970.

When the magnetic flux from the magnetic flux paths 966 and 968 is diverted through the magnetic flux path 970, the magnetic flux flowing through the right leg 906 increases significantly. According to Faraday's Law of induction, such a change in magnetic flux induces an electromotive force in the output coil 999 (FIG. 20), thereby converting the potential magnetic energy of the magnet 930 into kinetic electrical energy which may be used to provide electrical power to a load (not shown), as set forth above.

Furthermore, as set forth above, Lenz's Law states that the polarity of the electromotive force in the output coil 999 produces a current whose magnetizing force opposes the original change in flux. However, as shown by FIG. 22, the magnetic power converter 900 is a balanced reluctance bridge and the magnetic flux from the permanent magnet 930 is indirectly controlled by the input coil 940. Therefore, the magnetizing force only opposes the magnet 930 rather than the input coil 940 since the input coil 940 is isolated from the output coil 999. Such isolation has been demonstrated above with respect to the magnetic power converters 10, 100 and 200. Furthermore, the magnetizing force required to coerce the magnet 930 is relatively high such that the output coil 999 does not produce a force sufficient to coerce the magnet 930.

The total input power is defined by the equation $$P_{in}=I_{in}^2R_{in}$$

where $I_{in}$ is the input current and $R_{in}$ is the total input resistance. Thus, when the input current ($I_{in}$) is equal to 1010 mA and the input resistance ($R_{in}$) is equal to 0.899 Ohms, the total input power ($P_{in}$) of the magnetic power converter 900 is set forth in the equation $$P_{in}=(0.1010\text{ A})^2\times(0.899\Omega)$$

which equals approximately 0.919 W. In such embodiment, the total output power ($P_{out}$) has been measured at 10.3 W. Accordingly, by indirectly controlling the magnetic flux from the permanent magnet 930, which is a constant magnetic flux source until coerced, power is generated in the output coil 999.

Note that the orientation of the electromagnetic polarity of the input coil 940 does not affect the performance of the magnetic power converter 900. Thus, if the electromagnetic polarity of the input coil 940 is oriented towards the lower transverse piece 912, the control flux 960 will complete its flux path through the permanent magnet 930. However, none of the control flux 960 will reach the output coil 999 due to the high reluctance in the lower transverse piece 912 produced by the permanent magnet 930, as shown by FIG. 22. Furthermore, as set forth above, the magnetizing force produced by the output coil 999 only opposes the magnetizing force of the permanent magnet 930 thereby mitigating the effect of Lenz's Law.

What is claimed is:

1. A magnetic power converter, comprising:

a generally figure-8 shaped core having a plurality of transverse pieces and a plurality of legs;

at least one toroid integrated into at least one of the legs, the toroid having a first portion and a second portion;

a permanent magnet positioned within at least one of the legs;

an output coil positioned around one of the legs;

at least one input coil positioned around a portion of each toroid; and an alternating current (A/C) input power source, wherein the permanent magnet forms a magnetic circuit through the core arranged as a balanced reluctance bridge, the input coil indirectly controls the output coil, and the core comprises a left leg comprising a first permanent magnet disposed within a first toroid, a central leg comprising the output coil, and a right leg comprising a second permanent magnet disposed within a second toroid.

2. The magnetic power converter of claim 1, wherein each toroid comprises a first input coil positioned around a first portion of the toroid and a second input coil positioned around a second portion of the toroid, and wherein the first input coil and the second input coil are oriented such that the polarity of the first input coil is in opposition to the polarity of the second input coil with respect to the output coil when input power source is activated.

3. The magnetic power converter of claim 1, wherein the toroid is integrated into a first leg, the permanent magnet is positioned within a second leg, and the output coil is positioned around a third leg.

4. The magnetic power converter of claim 1, wherein a first portion and a second portion of the toroid each comprise a pinch point, and the input coil is wound around one of the pinch points.

5. The magnetic power converter of claim 1, wherein the plurality of transverse pieces and plurality of legs lie in substantially the same plane.

6. The magnetic power converter of claim 1, wherein the core is comprised of a plurality of 29 gauge M19 electrical steel laminations with a stack thickness of substantially one inch.

7. The magnetic power converter of claim 1, wherein the permanent magnet is comprised of a substantially one-inch cube of neodymium iron boron.

8. A magnetic power converter, comprising:

an upper transverse piece;

a lower transverse piece;

a plurality of legs substantially perpendicular to and extending between the upper and lower transverse pieces;

at least one toroid integrated into at least one of the legs, the toroid having a first portion and a second portion;

a permanent magnet positioned within at least one of the legs;

an output coil positioned around one of the legs; and at least one input coil positioned around a portion of each toroid, wherein permanent magnet forms a magnetic circuit through the upper transverse piece, the lower transverse piece, and the legs which is arranged as a balanced reluctance bridge, the input coil indirectly controls the output coil, and the plurality of legs comprises a left leg comprising a first permanent magnet disposed within a first toroid, a central leg comprising the output coil, and a right leg comprising a second permanent magnet disposed within a second toroid.

9. The magnetic power converter of claim 8, wherein the north poles of the first and second permanent magnets are oriented toward the upper transverse piece.

10. The magnetic power converter of claim 8, wherein the toroid is integrated into a first leg, the permanent magnet is positioned within a second leg, and the output coil is positioned around a third leg.

11. The magnetic power converter of claim 10, wherein the north pole of the permanent magnet is oriented toward the upper transverse piece.

12. The magnetic power converter of claim 11, wherein the input coil is positioned around a portion of the toroid.

13. The magnetic power converter of claim 12, further comprising a first input coil positioned around a first portion of the toroid and a second input coil positioned around a second portion of the toroid.

14. The magnetic power converter of claim 13, wherein the first input coil and the second input coil are oriented such that the polarity of the first input coil is in opposition to the polarity of the second input coil with respect to the output coil when power is applied to the first input coil and second input coil.

15. The magnetic power converter of claim 8, wherein the upper transverse piece, the lower transverse piece, and the plurality of legs are comprised of a plurality of 29 gauge M19 electrical steel laminations with a stack thickness of substantially one inch.

16. The magnetic power converter of claim 8, wherein the permanent magnet is comprised of a substantially one-inch cube of neodymium iron boron.

* * * * *